US005517228A

United States Patent [19]

Obu et al.

[11] Patent Number: 5,517,228

[45] Date of Patent: May 14, 1996

[54] APPARATUS FOR DISPLAYING A RECORDING MEDIUM SHEET AND PRINTING AN IMAGE THEREON

[75] Inventors: Makoto Obu, Yokohama; Masaru Shimada, Shizuoka; Itsuo Ikeda, Sagamihara; Noriyoshi Tarumi, Tokyo; Hiroshi Goto, Fuji, all of Japan

[73] Assignee: Ricoh Co., Ltd., Tokyo, Japan

[21] Appl. No.: 43,130

[22] Filed: Apr. 5, 1993

[30] Foreign Application Priority Data

Apr. 15, 1992 [JP] Japan ..... 4-095079

[51] Int. Cl.[6] ..... B41J 2/32

[52] U.S. Cl. ..... 347/171; 358/296

[58] Field of Search ..... 358/296; 347/171, 347/221; 400/120.01; 353/122

[56] References Cited

U.S. PATENT DOCUMENTS

| | | | |
|---|---|---|---|
| 4,839,731 | 6/1989 | Saka | 358/296 |
| 4,851,924 | 7/1989 | Nakamura et al. | 358/296 |

FOREIGN PATENT DOCUMENTS

| | | |
|---|---|---|
| 55-154198 | 12/1980 | Japan . |
| 57-94780 | 6/1982 | Japan . |
| 61-258853 | 11/1986 | Japan . |
| 63-38927 | 2/1988 | Japan . |
| 63-184782 | 7/1988 | Japan . |

*Primary Examiner*—Huan H. Tran
*Attorney, Agent, or Firm*—Cooper & Dunham

[57] ABSTRACT

An apparatus for displaying a recording medium sheet and for printing an image thereon includes a plurality of sheets each of which is made of an erasable recording medium, a recording unit for recording information on one of the plurality of sheets, a displaying unit for displaying the sheet on which information is recorded by the recording unit, the sheet being set at a display position when it is displayed, a sheet supplying unit for supplying one of the sheets to the recording unit, and for receiving the displayed sheet from the displaying unit, a sheet passage in which one of the sheets is transported from the displaying unit to the sheet supplying unit via the recording unit, and a sheet passage in which the sheet is transported from the sheet supplying unit to the displaying unit via the recording unit.

19 Claims, 20 Drawing Sheets

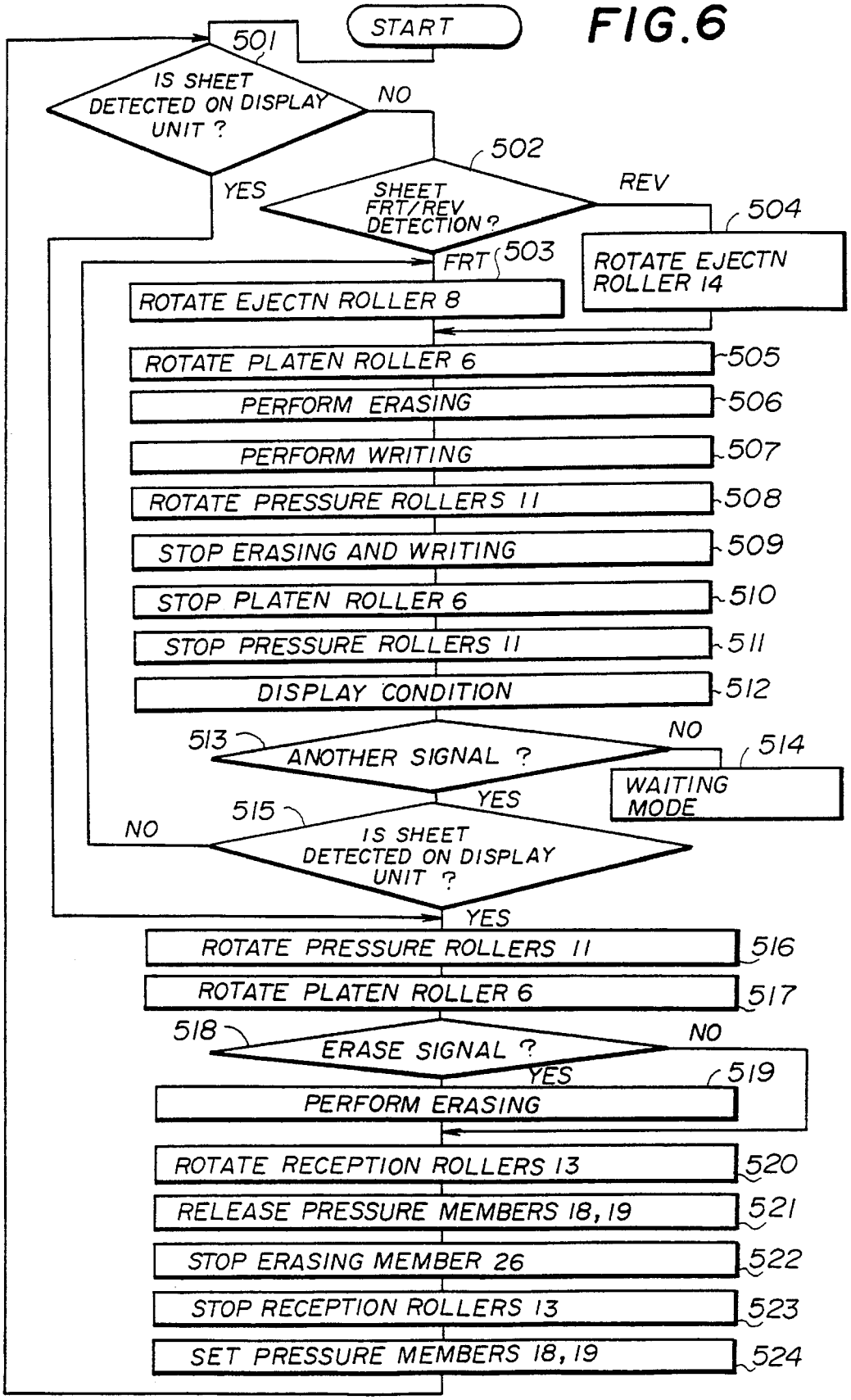
FIG.6
START
501
IS SHEET DETECTED ON DISPLAY UNIT ?
NO
YES
502
SHEET FRT/REV DETECTION ?
REV
FRT
503
504
ROTATE EJECTN ROLLER 14
ROTATE EJECTN ROLLER 8
ROTATE PLATEN ROLLER 6
505
PERFORM ERASING
506
PERFORM WRITING
507
ROTATE PRESSURE ROLLERS 11
508
STOP ERASING AND WRITING
509
STOP PLATEN ROLLER 6
510
STOP PRESSURE ROLLERS 11
511
DISPLAY CONDITION
512
513
ANOTHER SIGNAL ?
NO
514
WAITING MODE
YES
515
NO
IS SHEET DETECTED ON DISPLAY UNIT ?
YES
ROTATE PRESSURE ROLLERS 11
516
ROTATE PLATEN ROLLER 6
517
518
ERASE SIGNAL ?
NO
YES
519
PERFORM ERASING
ROTATE RECEPTION ROLLERS 13
520
RELEASE PRESSURE MEMBERS 18, 19
521
STOP ERASING MEMBER 26
522
STOP RECEPTION ROLLERS 13
523
SET PRESSURE MEMBERS 18, 19
524

APPARATUS FOR DISPLAYING A RECORDING MEDIUM SHEET AND PRINTING AN IMAGE THEREON

BACKGROUND OF THE INVENTION

The present invention generally relates to an image output apparatus, and more particularly to an image output apparatus for displaying and printing image data using an erasable recording medium sheet on which image data can be recorded and erased so that the sheet can be reused for displaying and printing image data.

FIG. 1 shows an image output device for outputting image data on a recording medium. In the device shown in FIG. 1, a sheet supplying unit 1, a recording unit 3 having a writing member 2, and a display unit 4 are provided. A plurality of recording medium sheets 5 are accommodated in the sheet supplying unit 1. The sheet supplying unit 1 includes a roller 8 for transporting one of the sheets 5. One of the sheets 5 is fed from the sheet supplying unit 1 to the recording unit 3. The recording unit 3 includes a platen roller 6 and a sheet guiding passage 7.

In order to display the sheet 5 at a display position on the displaying unit 4, the roller 8 is driven in accordance with a signal from a control part (not shown), so that the sheet 5 is transported from the sheet supplying unit 1 to the recording unit 3. The sheet 5 is transported to the platen roller 6 through the sheet feeding passage 7 by rotation of the roller 8, and it is further transported to the writing member 2 by rotation of the platen roller 6, so that information is written to the sheet 5 by the writing member 2. After the writing is finished, the sheet 5 is transported to the displaying unit 4, so that the sheet 5 is set at a display position on the displaying unit 4. When the sheet 5 on the displaying unit 4 is not needed after it is displayed, the sheet 5 is manually removed by an operator.

Conventionally, there is another image output device in which a display part using a belt-like erasable heat-sensitive recording medium, a printing part using a non-erasable heat-sensitive recording medium, and a thermal head shared by the display part and the printing part are provided. In this image output device, it is impossible to automatically return a recording medium sheet 5 from the displaying unit 4 to the sheet supplying unit 1.

There is a different image output apparatus which utilizes a belt-like erasable heat-sensitive recording medium sheet, and a heating unit, so that the sheet is set to a suitable temperature by the heating unit. When data is written to the sheet, the sheet is heated to a writing temperature. In order to erase the data written to the sheet, the sheet is cooled to an erasing temperature. When the sheet with the recorded data is displayed, the sheet temperature is maintained at a suitable temperature. Generally, erasable recording media used for image output apparatuses are classified into photochromic recording media, electrochromic recording media, and thermochromic recording media.

Japanese Laid-Open Patent Publication No.63-184782 discloses an image displaying device which utilizes a recording medium sheet formed into two thermochromic layers. Japanese Laid-Open Patent Publication No.55-154198 discloses a thermochromic recording medium which a hybrid film made of a high-molecular organic compound and a low-molecular organic compound. The thermochromic recording medium becomes white or transparent depending on the film temperature when the film is heated to a temperature higher than or lower than the upper temperature limit.

Japanese Laid-Open Patent Publication No.61-258853 discloses a blended composition for an erasable heat-sensitive recording medium which can control light tranmission by heat and can memorize color. The composition comprises a blended material of two component system showing a phase diagram of lower critical solution temperature (LCST) type such as a blended material of two components: vinylidene fluoride polymer and (meth)acrylic ester polymer. One of the two components is a low molecular polymer. It is suggested in Japanese Laid-Open Patent Publication No.61-258853 that if the composition disclosed therein is used for the recording medium, the recording medium shows the erasable recording characteristic since the opaque conditions of the recording medium can be maintained at normal temperature.

There is a known image output method in which the light scattering due to the change of the orientation of liquid crystal high molecular particles is utilized so that an image can be visualized at normal temperature due to changes in the opacity of the recording medium. Japanese Laid-Open Patent Publication No.57-94780 discloses an image output device utilizing the image output method as mentioned above. Japanese Laid-Open Patent Publication No.63-38927 discloses an over-head projector (OHP) device utilizing the image output method as mentioned above.

In a conventional image output apparatus as mentioned above, the recording medium sheet to which information is written is merely placed on the displaying unit. If the display of the sheet is no longer necessary, an operator must manually remove the sheet from the displaying unit. There is no mechanism to automatically return the displayed sheet from the displaying unit to the sheet supplying unit or other portions in the above mentioned image output apparatus. In addition, it is impossible to eject the displayed sheet from the apparatus, and it is difficult to re-use the recording medium sheet after data is written to the sheet and the sheet is displayed. However, there is a demand for the re-use of the recording medium sheet, used by the image output apparatus, in order to achieve filing, copying and displaying of the sheet on a different image processing apparatus.

SUMMARY OF THE INVENTION

Accordingly, it is a general object of the present invention to provide an improved image output apparatus in which the above described problems are eliminated.

Another, more specific object of the present invention is to provide an image output apparatus for displaying and printing image data on an erasable recording medium sheet in which the sheet, after it is displayed on a displaying unit, can be easily returned to a sheet supplying unit, and that the sheet after it is displayed or data is printed to the sheet can be re-used in order to achieve filing, copying, and displaying on a different image processing apparatus. The above mentioned object of the present invention is achieved by an image output apparatus which includes a plurality of sheets each of which is made of an erasable recording medium, a recording unit for recording information to one of the plurality of sheets, a displaying unit for displaying the sheet on which information is recorded by the recording unit, the sheet being set at a display position when it is displayed, a sheet supplying unit for supplying one of the sheets to the recording unit, and for receiving the displayed sheet from the displaying unit, a sheet passage through which one of the sheets is transported from the displaying unit to the sheet supplying unit via the recording unit, and a sheet passage through which the sheet is transported from the sheet supplying unit to the displaying unit via the recording unit.

According to the present invention, it is possible to automatically return a recording medium sheet after it is displayed on the displaying unit to the sheet supplying unit with no need for an operator to manually remove the sheet from the displaying unit. It is possible to automatically take out a recording recording sheet from the sheet supplying unit to display it again on the displaying unit or to erase image data from the sheet and return it to the sheet supplying unit. The recording medium sheet used by the image output apparatus can be reused, and the cost needed for displaying and printing can be lowered. The image output apparatus has a simple structure, and an image output system of small size can be built.

Other objects and further features of the present invention will become apparent from the following detailed description when read in conjunction with the accompanying drawings.

BRIEF DESCRIPTION OF THE DRAWINGS

FIG. 6 is a flow chart for explaining the operation of the second embodiment shown in FIG. 4;

DESCRIPTION OF THE PREFERRED EMBODIMENTS

Figure 1:
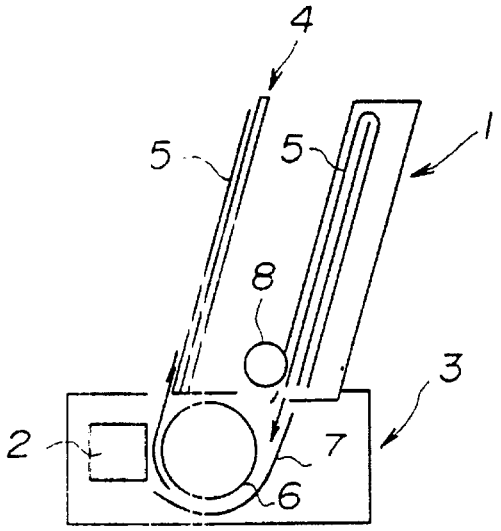
FIG. 1 PRIOR ART
FIG. 1 is a sectional view showing a display device using a recording medium sheet.
Figure 2:
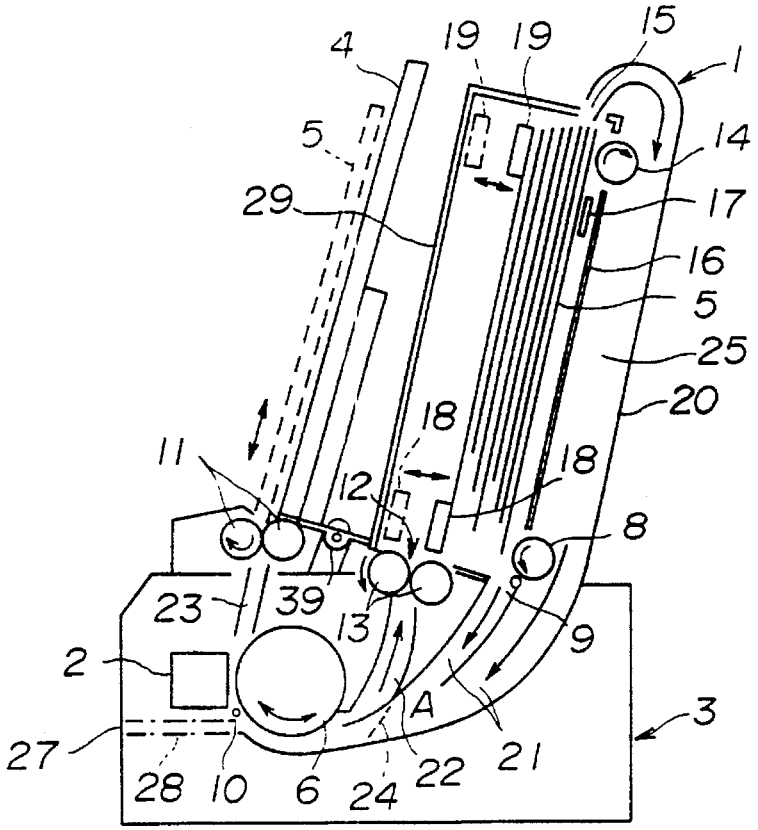
FIG. 2 is a sectional view showing a first embodiment of the image output apparatus according to the present invention.

A description will be given of the construction of the image output apparatus for displaying and printing image data according to the present invention. FIG. 2 shows a first embodiment of the present invention. In FIG. 2, the parts which are the same as corresponding parts of the apparatus shown in FIG. 1 are designated by the same reference numerals, and a description thereof will be omitted.

In the first embodiment shown in FIG. 2, a sheet supplying unit 1, a recording unit 3 with a writing member 2, a display unit 4, and a sheet-like, erasable recording medium 5 are provided. The apparatus includes a sheet feeding path for transporting the recording medium 5 from the sheet supplying unit 1 to the recording unit 3 and for transporting the recording medium 5 from the recording unit 3 to the display unit 4, and a sheet return path for transporting the recording medium 5 from the display unit 4 back to the sheet supplying unit 1.

In the first embodiment shown in FIG. 2, a marking used for locating the recording medium 5 in the correct position is recorded on a prescribed portion of the recording medium 5. A pair of pressure rollers 11 are provided at the bottom portion of the display unit 4 so as to transport the recording medium 5 by rotation of the pressure rollers 11 when the prescribed portion of the recording medium 5 is detected by sensing the marking on the recording medium 5. In order to transport the recording medium 5 from the recording unit 3 to the display unit 4, the pressure rollers 11 are rotated in the forward rotating direction by a drive motor (not shown). The recording medium 5 is held by the pressure rollers 11 at the display position on the front surface of the display unit 4. In order to transport the recording medium 5 from the display unit 4 back to the sheet supplying unit 1, the pressure rollers 11 are rotated in the reverse rotating direction by the drive motor. The recording medium 5 is returned back to the sheet supplying unit 1 by rotation of the pressure rollers 11.

In the display unit 4, a writing member is provided to write information on the reverse side of a recording medium through a transparent display portion of the display unit 4 when the recording medium 5 is held at the display position on the display unit 4. Also, in the display unit 4, a lamp is provided on the reverse side of the display unit 4 to illuminate the recording medium 5 when it is held at the display position on the front side of the display unit 4.

At a bottom rear-side portion of the sheet supplying unit 1 (corresponding to a top, rear-side portion of the recording unit 3), a first ejection opening 9 is formed, and a first ejection roller 8 is provided above the first ejection opening 9. At a bottom middle portion of the sheet supplying unit 1 (corresponding to a top middle portion of the recording unit 3), a sheet reception opening 12 is formed, and a pair of reception rollers 13 are provided below the sheet reception opening 12. At a top rear-side portion of the sheet supplying unit 1, a second ejection opening 15 is formed, and a second ejection roller 14 is provided below the second ejection opening 15.

The distance between the first ejection roller 8 and the second ejection roller 14 is preset such that one end of the recording medium 5 comes into contact with the roller 8 at the same time that the other end comes into contact with the roller 14. A sheet support plate 16 is provided to support the intermediate portion of the recording medium 5. A front/reverse surface sensing part 17 is mounted on a prescribed portion of the sheet support plate 16. The prescribed portion of the sheet support plate 16 on which the sensing part 17 is mounted corresponds to the position of a front/reverse surface detection marking on the recording medium 5.

In the first embodiment shown in FIG. 2, the front/reverse surface sensing part 17 detects whether the front surface of the recording medium 5 or the reverse surface thereof is in contact with the sheet support plate 16 of the sheet supplying unit 1. When the sheet of the recording medium 5 with the image data in a normal condition has been placed in the sheet supplying unit 1 and the displaying of the front surface of the recording medium 5 is needed, the second ejection roller 14 is rotated in accordance with a front-surface display signal to transport the recording medium 5 from a rear-side passage 25 of the sheet supplying unit 1 to the display unit 4. The front surface of the recording medium 5 is displayed on the display unit 4. When the displaying of the reverse surface of the recording medium 5 is desired, the first ejection roller 8 is rotated in accordance with a reverse-surface display signal to transport the recording medium 5 from the sheet feeding passage 21 to the display unit 4. The reverse surface of the recording medium 5 is then displayed on the display unit 4.

Conversely, when the recording medium 5 with the image data in an inverted condition has been placed in the sheet supplying unit 1, the second ejection roller 14 is rotated in accordance with the reverse-surface display signal to transport the recording medium 5 from the passage 25. The first ejection roller 8 is rotated in accordance with the front-surface display signal to transport the recording medium 5 from the passage 21.

A first pressure member 18 and a second pressure member 19 are provided at positions of the sheet supplying unit 1 which positions are aligned to those of the first ejection roller 8 and the second ejection roller 14 respectively with the sheet of the recording medium 5 interposing between the pressure members and the rollers.

In the recording unit 3, a writing position sensor 10 is mounted at a prescribed position upstream of the writing member 2 to sense the marking on the recording medium 5 so that image data is written to the correct position when the prescribed position of the recording medium 5 is detected.

In the recording unit 3, a sheet feeding passage 21 is formed so as to extend from the first ejection opening 9 of the sheet supplying unit 1. Also, in the recording unit 3, a sheet ejecting passage 22 is formed so as to extend from the sheet reception opening 12 of the sheet supplying unit 1. A selecting lever 24 is provided at a portion "A" of the recording unit 3 where the sheet feeding passage 21 and the sheet ejection passage 22 join within the recording unit 3. The selecting lever 24 is mechanically or electrically moved so as to select one of the two passages 21 and 22 in which the recording medium 5 is transported.

In the recording unit 3, a sheet transport passage 23 is formed between the pressure rollers 11 and the writing member 2, and the recording medium 5 is transported in the sheet transport passage 23 in both the sheet feeding and return directions. A sheet sensor (not shown) is provided in each of the sheet feeding passage 21, the sheet return passage 22, and the sheet transport passage 23 to sense the presence of the recording medium 5 in each passage.

In the first embodiment shown in FIG. 2, the type of the writing member 2 is selected in accordance with the characteristics of the source material of the sheet-like, erasable recording medium 5. If the recording medium 5 is the thermochromic type which utilizes color variations under the influence of heat, a thermal head having heating elements is used as the writing member 2. If the recording medium 5 is the photochromic type which utilizes toner development under the influence of light, the writing member 2 is an electrode and the recording medium 5 is a dieltric sheet so that an electrostatic latent image is formed on the recording medium 5. An image is formed on the recording medium 5 by toner development of the electrostatic latent image.

The operation of the apparatus shown in FIG. 2 when the recording medium 5 to which image data has been written is displayed on the display unit 4 will be described. The recording medium 5 with the image data in the inverted condition has been placed in the sheet supplying unit 1 in the vicinity of a rear side plate 20 thereof.

In accordance with a control signal from the control part (not shown), the first ejection roller 8 is rotated in the forward direction so that the recording medium 5 is transported via the sheet feeding passage 21 from the first ejection opening 9 to the platen roller 6. The recording medium 5 is pressed between the platen roller 6 and the writing member 2, and it passes through the writing member 2 at this time. The recording medium 5 is sent to the sheet transport passage 23 by rotation of the platen roller 6, and it is transported in the sheet transport passage 23 by rotation of the pressure rollers 11, so that the recording medium 5 is sent to the display unit 4 and it is displayed on the display unit 4 at the display position thereof.

The operation of the apparatus shown in FIG. 2 when the recording medium 5 with no written data is displayed on the display unit 4 will be described. The recording medium 5 is transported via the sheet feeding passage 21 from the sheet supplying unit 1 to the platen roller 6 as described above. In accordance with a record signal sent from an external terminal such as a computer, a wordprocessor or a facsimile machine, image data is written to the recording medium 5 by the writing member 2 while it is pressed between the platen roller 6 and the writing member 2. After the writing of the image data is finished, the pressure rollers 11 are rotated to transport the recording medium 5 from the recording unit 3 to the display unit 4 so that the recording medium 5 is displayed on the display unit 4 at the display position thereof. When the position of the recording medium 5 reaches the display position, the rotation of the pressure rollers is stopped, and the recording medium 5 is maintained by the pressure rollers 11 there. It is possible to automatically remove the recording medium 5 from the display unit 4 so that the recording medium 5 with the written image data can be used as an original for copying purposes, or as an OHP sheet for displaying purposes.

When it is no longer necessary that the recording medium 5 be displayed on the display unit 4 in the first embodiment shown in FIG. 2, the pressure rollers 11 and the platen roller 6 are rotated in the reverse rotating direction in accordance with a return signal from the control part (not shown). The recording medium 5 is transported via the sheet transport passage 23 from the display unit 4 to the recording unit 3 by rotation of the pressure rollers 11 and the platen roller 6. The selecting lever 24 at the portion "A" of the recording unit 3 is moved to a position indicated by a dotted line in FIG. 2 so that the recording medium 5 is sent to the sheet reception opening 12 of the sheet supplying unit 1 through the sheet ejecting passage 22. The reception rollers 13 are rotated so that the recording medium 5 enters the sheet supplying unit 1 from the sheet reception opening 12. The first and second pressure members 18 and 19 are previously placed at positions indicated by dotted lines in FIG. 2. After the recording medium 5 enters the sheet supplying unit 1, the pressure members 18 and 19 are placed at positions indicated by solid lines in FIG. 2 so that the recording medium 5 is suitably arranged therein.

When the recording medium 5 received from the recording unit 3 is again displayed on the display unit 4, a re-display request is made by an operator and a re-display signal is sent from the control part. In accordance with the re-display signal from the control part, the pressure members 18 and 19 are placed back in the positions (the release positions) indicated by the dotted lines. The reception rollers 13 are rotated in the reverse rotating direction to transport the recording medium 5 from the sheet reception opening 12 via the sheet ejecting passage 22 and to the display unit 4 via the sheet transport passage 23. In this manner, the recording medium 5 is transported in both the forward and reverse directions via the passages 21–23 between the sheet supplying unit 1 and the display unit 4.

In the first embodiment shown in FIG. 2, a sheet insertion opening 27 as indicated by a dotted dash line in FIG. 2 is formed at the front portion of the recording unit 3, so that a recording medium from an external unit can be inserted by means of the sheet insertion opening 27. An insertion passage 28 is formed in the vicinity of the writing member 2 so as to extend from the sheet insertion opening 27. The recording medium 5 from the sheet insertion opening 27 can be transported to the sheet supplying unit 1 by rotation of the platen roller 6.

In the first embodiment shown in FIG. 2, when the first ejection roller 8 is rotated, one end of the recording medium 5 is pressed between the first pressure member 18 and the first ejection roller 8. The second pressure member 19 is placed at the release position so that the other end of the recording medium 5 is not pressed by the second pressure member 19. When the second ejection roller 14 is rotated, one end of the recording medium 5 is pressed between the second pressure member 19 and the second ejection roller 14. The first pressure member 18 is placed at the release position so that the other end of the recording medium 5 is not pressed by the first pressure member 18. It is possible to smoothly transport the recording medium 5 from the sheet supplying unit 1 to the recording unit 3.

In the apparatus shown in FIG. 2, a covering plate 29 is formed integrally with the display unit 4, and the covering plate 29 of the sheet supplying unit 1 is rotatably supported by a supporting member 39 at the top portion of the recording unit 3. When the sheet supplying unit 1 is replenished with new sheets of the recording medium 5, the covering plate 29 is opened so as to place the new sheets in the sheet supplying unit 1.

In the first embodiment shown in FIG. 2, a sheet-like erasing member may be provided on the front surface of the display unit 4. The erasing of image data on the recording medium 5 can be quickly performed, and can be seen or "observed to occur" on the display unit 4.

Figure 3B:
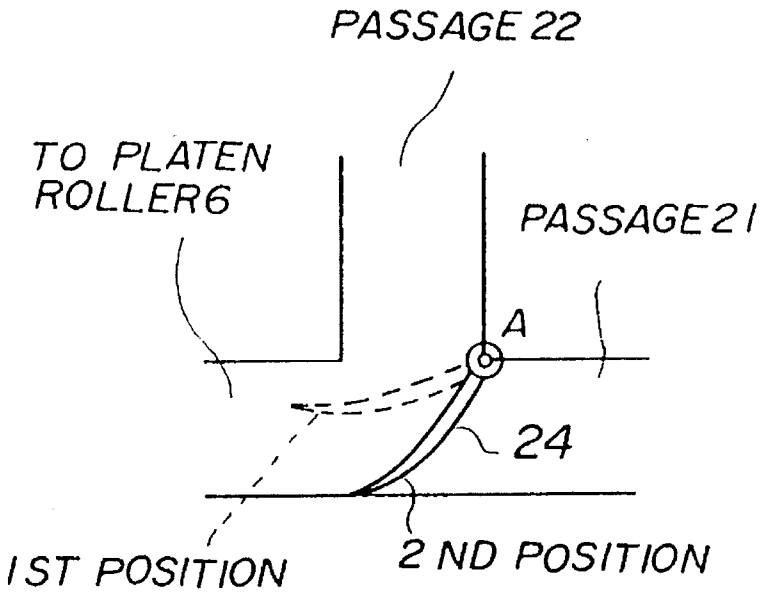
FIGS. 3A and 3B are diagrams for explaining the operation of a selecting lever of the apparatus shown in FIG. 2.
Figure 3A:
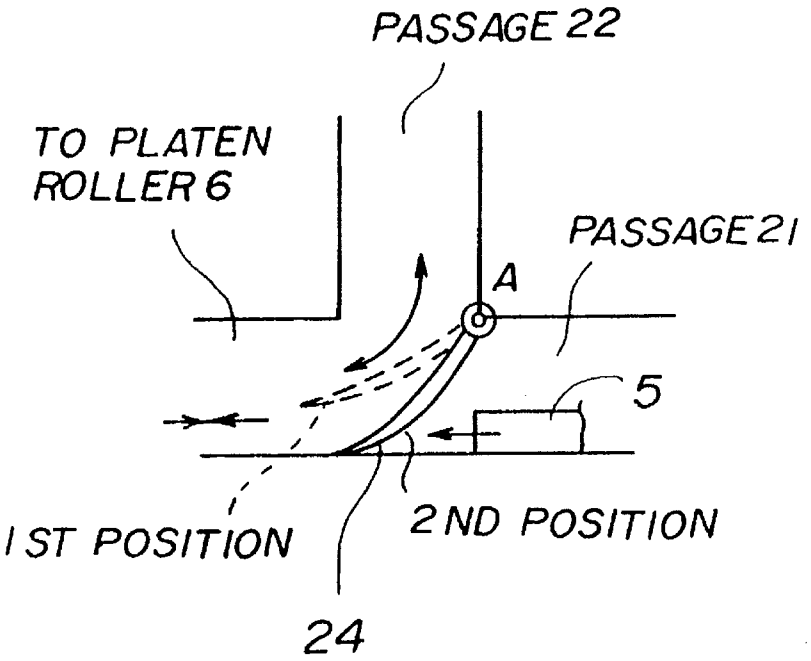

The operation of the selecting lever 24 in the apparatus shown in FIG. 2 will be described. The selecting lever 24 shown in FIG. 3A is rotatably supported at the portion "A", and it is biased in a normal condition to a second position indicated by the solid line. When the recording medium 5 is transported from the passage 21 to the platen roller 6, the selecting lever 24 is moved by the leading edge of the recording medium 5 to a first position indicated by the dotted line. In the case of the selecting lever 24 shown in FIG. 3A, it is not necessary to forcibly move the selecting lever 24 to the first position. However, it is possible to use the selecting lever 24 shown in FIG. 3B as required. The selecting lever 24 shown in FIG. 3B is mechanically or electrically moved between the first position indicated by the dotted line and the second position indicated by the solid line in accordance with the direction in which the recording medium 5 is transported. Obviously, the present invention is not limited to the selecting lever mentioned above, and other selecting parts which achieve the same function as that of the above mentioned selecting lever 24 may be used.

Figure 4:
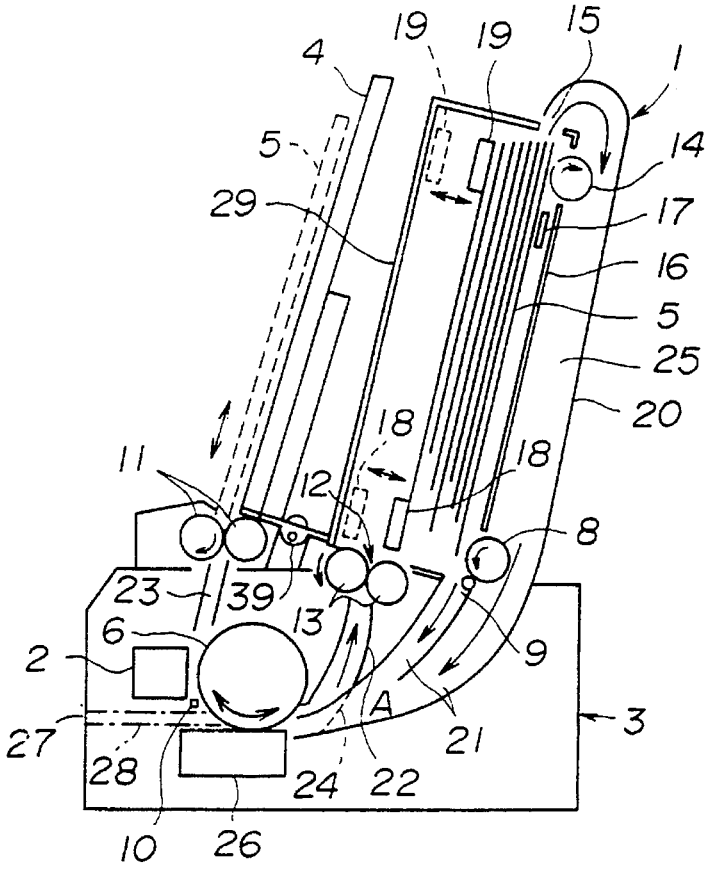
FIG. 4 is a sectional view showing a second embodiment of the image output apparatus according to the present invention.

FIG. 4 shows a second embodiment of the image output apparatus according to the present invention. In FIG. 4, the parts which are the same as corresponding parts shown in FIG. 2 are given the same reference numerals, and a description thereof will be omitted. In the apparatus shown in FIG. 4, an erasing member 26 is placed in contact with the platen roller 6 between the sheet feeding passage 21 and the writing member 2.

The type of the erasing member 26 of the second embodiment is selected in accordance with the characteristics of the source material of the sheet-like, erasable recording medium 5. If the recording medium 5 is the thermochromic type which utilizes color variations under the influence of heat, a heating member is used as the erasing member 26. If the recording medium 5 is the photochromic type which utilizes toner development under the influence of light, a cleaning blade or brush is used as the erasing member 26 so as to remove the toner from the recording medium 5.

In the second embodiment shown in FIG. 4, a recording medium 5 made of a thermochromic material is used. The erasing member 26 serves to erase the image data on the recording medium 5 by setting the temperature of the erasing member 26 to an uncoloring temperature suitable to make the recording medium 5 uncolored. After the erasing is performed, the temperature of the writing member 2 is set to a coloring temperature suitable to make the recording medium 5 colored, so that the writing member serves to write image data on the recording medium 5. The recording medium 5 to which the image data is written is then sent to the sheet supplying unit 1.

When the image data is confidential, the image data on the recording medium 5 can be erased by the erasing member 26 in accordance with a request from an operator before the recording medium 5 is sent to the sheet supplying unit 1. The temperature of the erasing member 26 can be set to one of three levels: uncoloring, coloring and normal (unheated) temperatures. When the recording medium 5 is transported, the writing member 2 and the erasing member 26 normally come into contact with the recording medium 5 against the platen roller 6. However, when the erasing or the writing is not needed, the writing member 2 and the erasing member 26 can be separated from the platen roller 6 in accordance with a request from an operator. When the recording medium 5 is sent from the display unit 4 to the sheet supplying unit 1, the writing member 2 and the erasing member 26 are not heated for writing or erasing, but serve as the members for transporting the recording medium 5 without heating.

Figure 5:
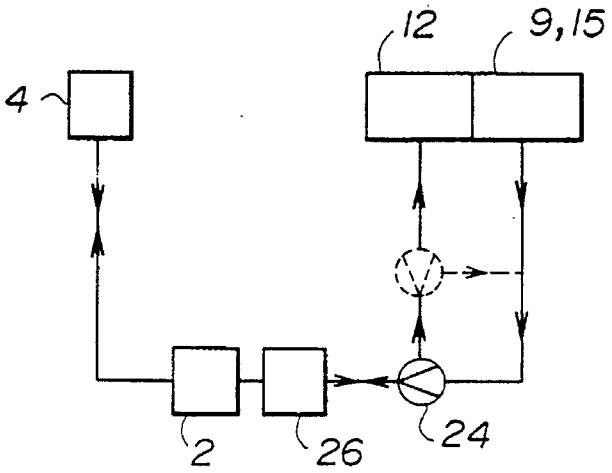
FIG. 5 is a diagram for explaining the sequence in which a recording medium sheet is transported in the apparatus shown in FIG. 4.

FIG. 5 shows the sequence in which the recording medium 5 is transported in the apparatus shown in FIG. 4. In FIG. 5, the parts of the apparatus (e.g., the platen roller 6) which are not related to the sequence of the transporting are omitted. The first and second ejection openings 9 and 15 are indicated by one block in FIG. 5. The sequence in which the recording medium 5 is transported when a two-sided recording is performed is indicated by a dotted line in FIG. 5. A path along which the recording medium 5 can be transported in a single direction is indicated by a single arrow "→" or "←" in FIG. 5. A path along which the recording medium 5 can be transported either in both directions is indicated by a double arrow "→←" in FIG. 5.

As shown in FIG. 5, when the recording medium 5 is fed from one of the two ejection openings 9 and 15, it passes through the selecting lever 24, the erasing member 26, and the writing member 2. The recording medium 5 is displayed on the display unit 4. When the recording medium 5 is fed from the display unit 4 to the sheet supplying unit 1, it passes through the writing member 2 and the erasing member 26. The recording medium 5 is then fed to the sheet reception opening 12 via the selecting lever 24.

FIG. 6 shows the operation of the second embodiment of the image output apparatus shown in FIG. 4. The operation shown in FIG. 6 starts when a record signal from an external terminal (such as a computer, a wordprocessor or a facsimile machine) is input to the image output apparatus which is in a waiting mode after turning ON a power switch of the apparatus. Step 501 detects whether or not a recording medium 5 (also called a sheet) is displayed on the display unit 4.

If step 501 detects that a sheet is currently being displayed on the display unit 4, the sheet is transported from the display unit 4 to the sheet supplying unit 1. Step 516 rotates the pressure rollers 11 to transport the sheet from the display unit 4 to the recording unit 3. Step 517 rotates the platen roller 6 to transport the sheet to the erasing member 26. Step 518 detects whether or not an erase signal is received by the erasing member 26. This erase signal is supplied to the erasing member 26 when the sheet is sent from the unit 4 to the unit 1 (which signal is automatically input from the control part or manually input as a request from an operator). If the erase signal is received, the erasing member 26 is driven in step 519 so that the data on the recording medium 5 is erased. If no erase signal is received, the erasing member 26 performs no function.

Step 520 rotates the reception rollers 13 to transport the sheet from the recording unit 3 to the sheet supplying unit 1. At the same time, step 521 resets the pressure members 18 and 19 to the release positions (indicated by the dotted lines in FIG. 4) so that the sheet is piled on the other sheets in the sheet supplying unit 1. After the sheet is completely placed into the sheet supplying unit 1, step 522 stops the operation of the erasing member 26, and step 523 stops the rotation of the reception rollers 13. Step 524 sets the pressure members 18 and 19 to the pressure positions (indicated by the solid lines in FIG. 4) so that the recording medium 5 is suitably placed in the sheet supplying unit 1. Then, the step 501 is again performed so as to detect whether or not a sheet exists on the display unit 4 in the manner described above.

If step 501 detects no sheet on the display unit 4, a writing procedure is performed so as to write information to the recording medium 5. This procedure will be described in the following. Step 502 detects whether the front surface of the sheet (the recording medium 5) or the reverse surface thereof is in contact with the sheet supplying unit 1 by means of the sensing part 17. If the front surface of the sheet is detected to be in contact, step 503 rotates the ejection roller 8 so as to eject the sheet from the first ejection opening 9 and send it to the platen roller 6. If the reverse surface of the sheet is detected to be in contact, step 504 rotates the ejection roller 14 so as to eject the sheet from the second ejection opening 15. The sheet is turned upside down when the sheet is transported in the passage 25.

Step 505 rotates the platen roller 6 to send the sheet to the erasing member 26 and to the writing member 2. Step 506 performs the erasing of image data previously recorded on the sheet by means of the erasing member 26. Step 507 performs the writing of information to the sheet by means of the writing member 2. After the writing is performed, step 508 rotates the pressure rollers 11 to transport the sheet from the recording unit 3 to the display unit 4. When it is detected that the rear edge of the transported sheet passes through the erasing member 26 and the writing member 2, step 509 stops the operation of the erasing member 26 and the operation of the writing member 2, respectively. After the sheet is displayed on the display unit 4, step 510 stops the rotation of the platen roller 6. Step 511 stops the rotation of the pressure rollers 11. Step 512 places the sheet at the display position of the display unit 4.

After the recording medium 5 is displayed, step 513 detects whether or not another record signal isreceived. If another record signal is received, step 515 detects whether or not a sheet exists on the display unit 4. The step 515 is the same as the step 501 described above. If the answer to the step 515 is affirmative, the step 516 is performed. If the answer to the step 515 is negative, the step 503 is performed.

If no signal is received in step 513, step 514 places the apparatus in a waiting mode while the recording medium 5 is displayed. After the recording medium 5 has been displayed for a given time period, the sheet is automatically or manually transported from the display unit 4 to the sheet supplying unit 1.

Figure 7:
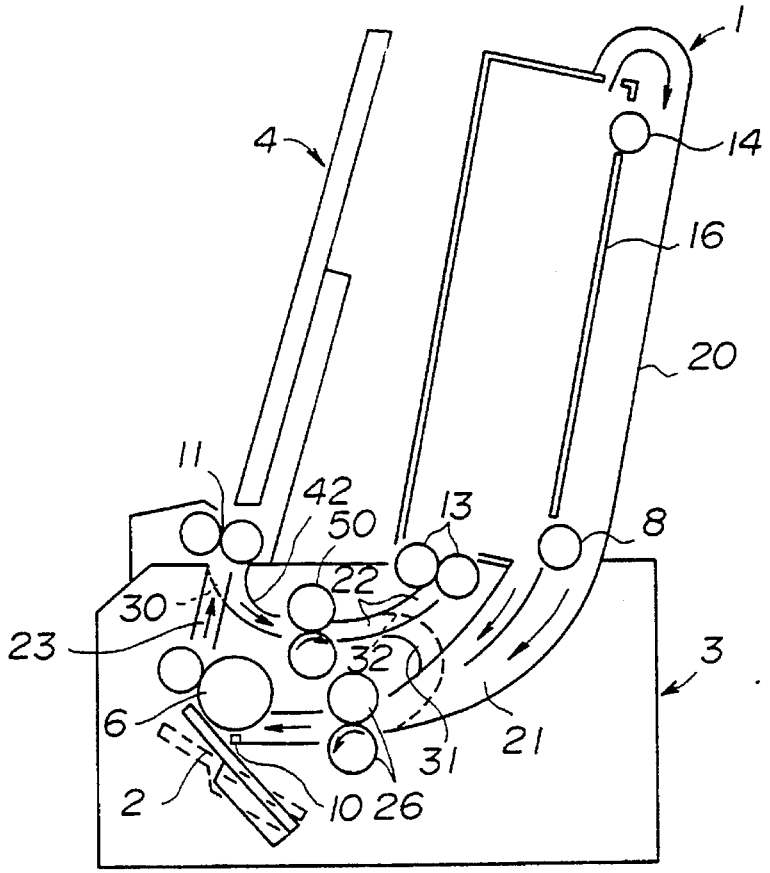
FIG. 7 is a sectional view showing a third embodiment of the image output apparatus according to the present invention.

FIG. 7 shows a third embodiment of the present invention. In FIG. 7, the parts which are the same as corresponding parts shown in FIG. 4 are given the same reference numerals, and a description thereof will be omitted. In the apparatus shown in FIG. 7, a return passage 42 between the display unit 4 and the sheet reception passage 22 (leading to the sheet supplying unit 1) is provided. A selecting lever 30 is provided at a portion (located below the pressure rollers 11) where the sheet transport passage 23 and the return passage 42 join. A second erasing member 50 is provided between the return passage 42 and the sheet reception passage 22. A duplex passage 31 (indicated by a dotted line in FIG. 7) is provided so as to connect the sheet reception passage 22 and the sheet ejection passage 21. A selecting lever 32 is provided at a portion (located in front of the reception rollers 13) where the sheet reception passage 22 and the duplex passage 31 join.

In the third embodiment shown in FIG. 7, the recording medium 5 which was displayed on the display unit 4 is sent to the return passage 42 by means of the selecting lever 30. The recording medium 5 is sent to the duplex passage 31 by means of the selecting lever 32, so that the sheet (on the front surface of which the image data is already recorded) is turned upside down. From the duplex passage 31, the recording medium 5 is again fed to the writing member 2 via the platen roller 6, and it is subjected to a duplex recording performed by the writing member 2 so as to record image data on the reverse surface of the sheet.

Figure 8:
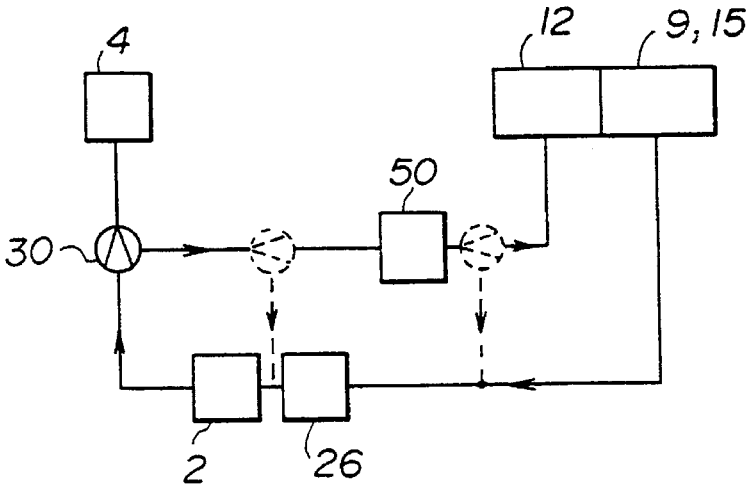
FIG. 8 is a diagram for explaining the sequence in which a recording medium sheet is transported in the apparatus shown in FIG. 7.

FIG. 8 shows the sequence in which the recording medium 5 is transported in the third embodiment shown in FIG. 7. As shown in FIG. 8, in addition to the sequence shown in FIG. 5, the recording medium 5 after it is displayed on the display unit 4 passes the selecting lever 30. After the recording medium 5 travels through the return passage 42, it passes through the second erasing member 50 located between the return passage 42 and the sheet reception passage 22.

Figure 9:
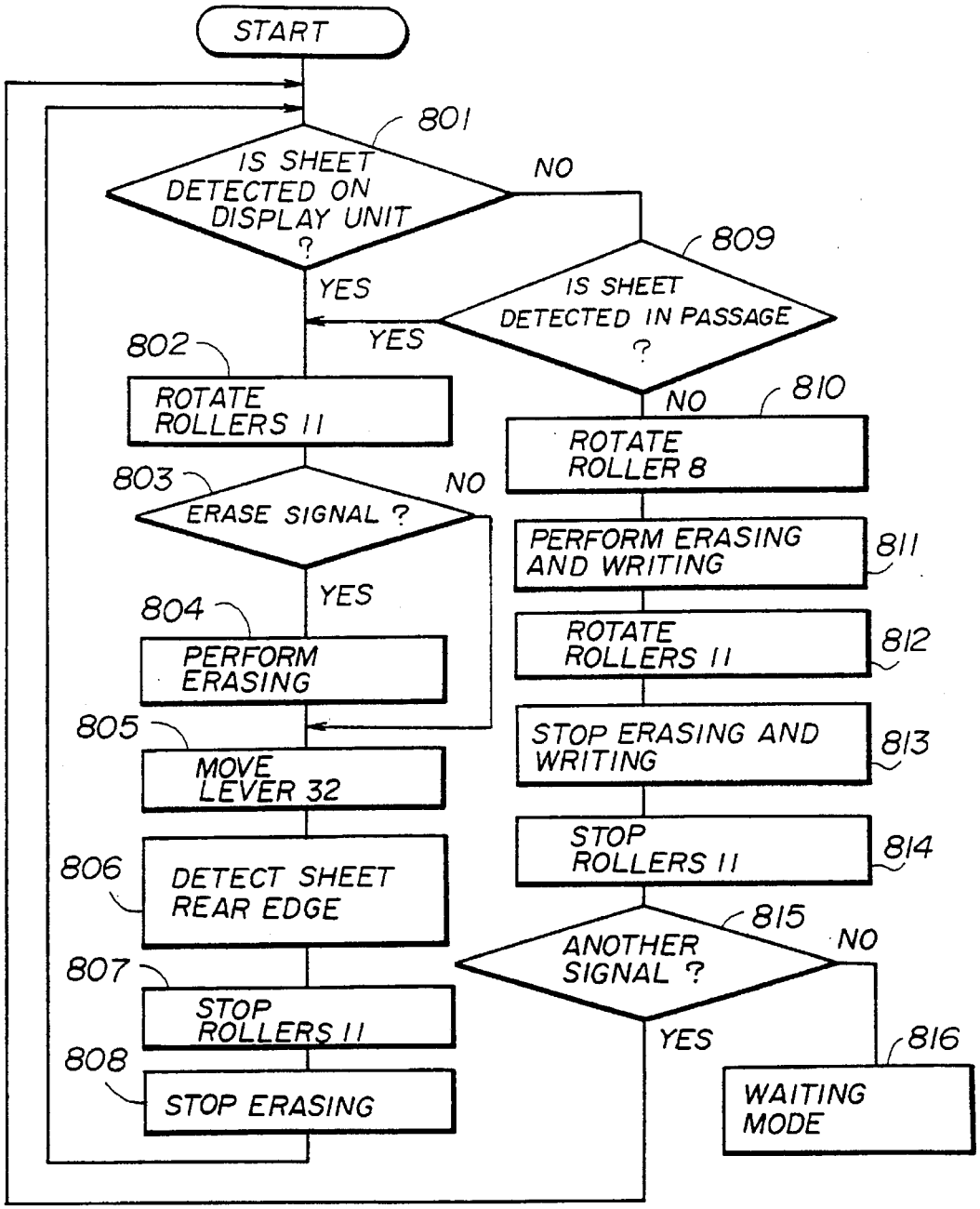
FIG. 9 is a flow chart for explaining the operation of the third embodiment shown in FIG. 7.

FIG. 9 shows the operation of the third embodiment of the present invention. The operation shown in FIG. 9 starts when a record signal (used to write information to the recording medium 5) from an external terminal is input to the image output apparatus which is in a waiting mode after turning ON a power switch of the apparatus. Step 801 detects whether or not a recording medium 5 (also called a sheet) is displayed on the display unit 4.

If step 801 detects a sheet displayed on the display unit 4, the sheet will be transported from the display unit 4 to the sheet supplying unit 1. Step 802 rotates the pressure rollers 11 in order to transport the sheet from the display unit 4 to the recording unit 3.

Step 803 detects whether or not an erase signal (used to erase information of the recording medium 5) is received by the erasing member 50. If the erase signal is received, step 804 drives the erasing member 50 to perform the erasing of the recording medium 5. If no erase signal is received, the erasing is not performed by the erasing member 50. This erase signal is automatically or manually supplied from the control part if needed when the sheet is sent from the display unit 4 to the sheet supplying unit 1.

Step 805 moves the selecting lever 32 in order to send the sheet to the sheet supplying unit 1. Step 806 detects that the rear edge of the recording medium 5 (the sheet being transported) has passed through the erasing member 50. Step 807 stops the rotation of the pressure rollers 11. Step 808 stops the operation of the erasing member 50. Then, the step 801 described above is performed.

If step 801 detects no sheet displayed on the display unit 4, step 809 detects whether or not a sheet exists in any passage of the apparatus. If the sheet is present in any passage of the apparatus, the step 802 described above is performed. If a sheet is present in none of the passages of the apparatus, step 810 rotates the feeding roller (8 or 14) in order to supply another sheet from the sheet supplying unit 1 to the unit 3.

Step 811 drives both the erasing member 26 and the writing member 2 so that the sheet is subjected to erasing by the erasing member 26 and writing by the writing member 2. After the leading edge of the sheet passes through the writing member 2, step 812 rotates the pressure rollers 11 in order to transport the sheet from the recording unit 3 to the display unit 4. After the sheet is displayed on the display unit 4, step 813 stops the operation of the erasing member 26 and the operation of the writing member 2. Step 814 stops the rotation of the pressure rollers 11. After the recording medium 5 is displayed, step 815 detects whether or not another record signal is received. If another record signal is received, the step 801 described above is performed. If no signal is received, step 816 places the apparatus in a waiting mode while the recording medium 5 is displayed. After the recording medium 5 has been displayed for a given time period, the sheet is automatically or manually transported from the display unit 4 to the sheet supplying unit 1.

Figure 10:
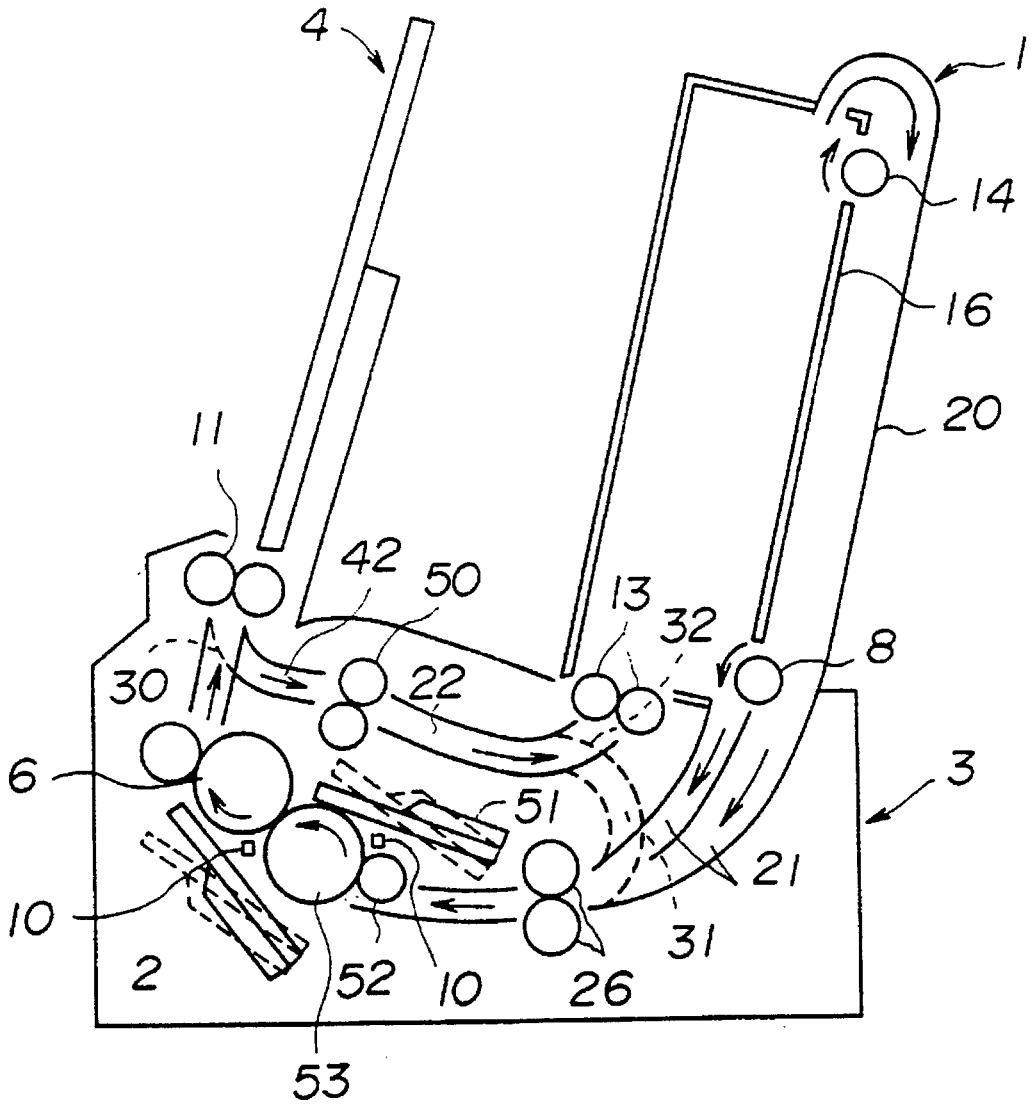
FIG. 10 is a sectional view showing a fourth embodiment of the present invention.

FIG. 10 shows a fourth embodiment of the present invention. In FIG. 10, the parts which are the same as corresponding parts shown in FIG. 7 are given the same reference numerals, and a description thereof will be omitted. In the apparatus shown in FIG. 10, a second writing member 51, a second platen roller 53 in contact with the platen roller 6, and a second transport roller 52 in contact with the second platen roller 53 are provided. In the fourth embodiment shown in FIG. 10, a recording medium 5 from the sheet supplying unit 1 is sent to the sheet feeding passage 21. The recording medium 5 passes through the erasing member 26, and the leading edge of the recording medium 5 is placed between the second transport roller 52 and the second platen roller 53. The recording medium 5 is then transported along an S-shaped path. One surface of the sheet is subjected to a first recording by means of the second writing member 51, and the other surface of the sheet is subjected to a second recording by means of the writing member 2. Thus, in the fourth embodiment shown in FIG. 10, it is possible to carry out a simultaneous two-sided recording on the recording medium 5 using the two writing members.

Figure 11:
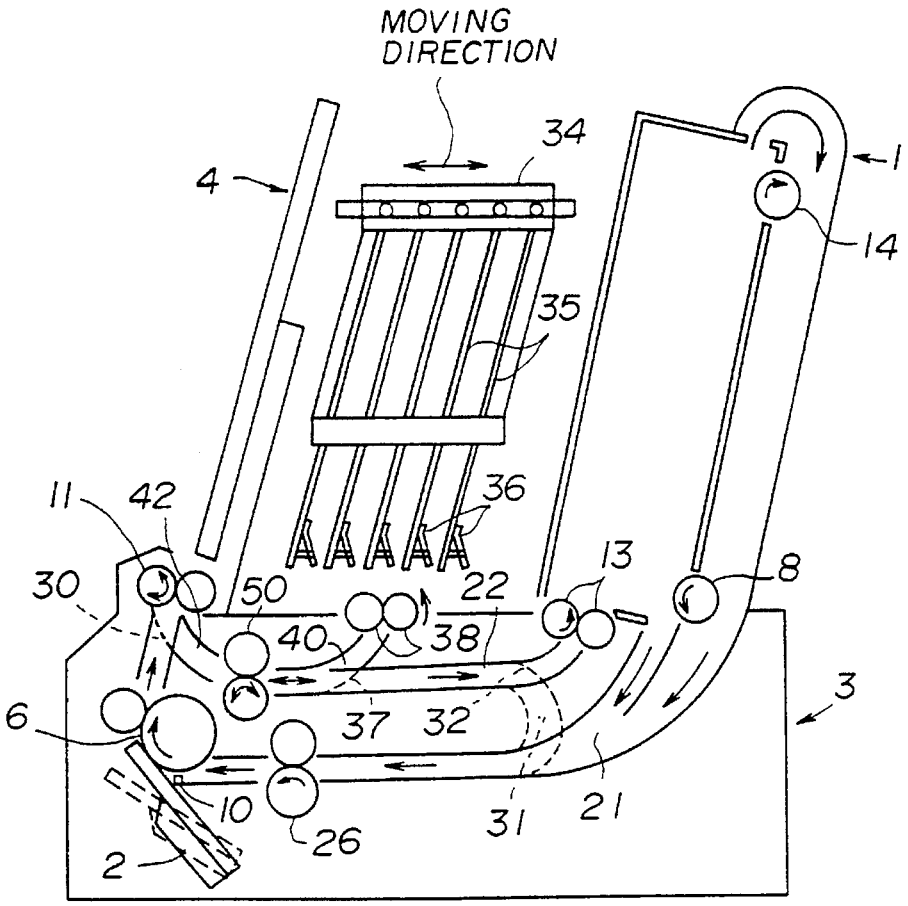
FIG. 11 is a sectional view showing a fifth embodiment of the present invention.

FIG. 11 shows a fifth embodiment of the present invention. In FIG. 11, the parts which are the same as corresponding parts shown in FIG. 7 are given the same reference numerals, and a description thereof will be omitted. In the apparatus shown in FIG. 11, a sheet holding part 34 having a plurality of separating plates 35 each having a clamp 36 at a bottom portion of the separating plate is provided. In the apparatus shown in FIG. 11, a pair of holding rollers 38, a second passage 40, and a second selecting lever 37 are further provided. The holding rollers 38 are arranged below the sheet holding part 34 in order to feed the sheet from the recording unit 3 to the sheet holding part 34. The second passage 40 is provided so as to extend from the second erasing member 50 to the holding rollers 38. The second passage 40 separates from the sheet reception passage 22 at an intermediate portion downstream of the second erasing member 50. The second selecting lever 37 is mounted at this portion where the second passage 40 and the sheet reception passage 22 meet.

Each separating plate 35 of the sheet holding part 34 serves to temporarily hold a sheet sent from the display unit 4 after it was displayed thereon. A sheet placed into the sheet holding part 34 is secured on each separating plate 35 by the clamp 36 at the bottom of the plate 35. The sheet is continuously held by the sheet holding part 34 until a control signal used to transport the sheet to the display unit 4 is issued automatically from the control part or manually upon a request by an operator. In accordance with the control signal, the sheet in the sheet holding part 34 is again transported to the display unit 4. The sheet holding part 34 is movably mounted on a main unit (not shown) of the apparatus in the directions indicated by the arrows in FIG. 11.

More specifically, in order to temporarily hold a sheet in the sheet holding part 34, the sheet from the display unit 4 is transported to the selecting lever 30 by rotation of the pressure roller 11. The selecting lever 30 is moved to a given position (indicated by a dotted line in FIG. 11) in order to send the sheet to the return passage 42. The sheet from the selecting lever 30 is transported to the second selecting lever 37 via the erasing member 50. The second selecting lever 37 at this time is moved to a given position (indicated by a dotted line in FIG. 11) in order to send the sheet to the holding rollers 38 through the second passage 40. The sheet is then placed to one of the separating plates 35 of the sheet holding part 34 by rotation of the holding rollers 38. After the sheet is placed in the sheet holding part 34, the clamp 36 of the separating plate 35 is driven to its closed condition so that the sheet is held by the sheet holding part 34. The sheet holding part 34 is moved relative to the main unit by means of a drive mechanism (not shown) such that each of the sheets from the display unit 4 is sequentially placed on one of the separating plates 35 of the sheet holding part 34.

In order to transport one of the sheets in the sheet holding part 34 to the display unit 4, the part 34 is moved relative to the main unit by the drive mechanism such that one of the separating plates 35 on which the sheet is held is located above the holding rollers 38. The corresponding clamp 36 is driven to its open condition to release the sheet from the sheet holding part 34. By rotation of the holding rollers 38, the sheet is transported to the erasing member 50, and by rotation of the erasing member 50 the sheet is transported to the pressure rollers 11. The sheet from the pressure rollers 11 is transported to the display unit 4 by rotation of the pressure rollers 11 so that the sheet is displayed on the display unit 4. The holding of the recording medium 5 by the sheet holding part 42, and the transporting of the recording medium 5 from the part 34 to the unit 4 are carried out in accordance with a control signal from the control part of the apparatus for each sheet of the recording medium 5. The control signal is used to transport each sheet from the unit 4 to the part 34 or vice versa.

Figure 12:
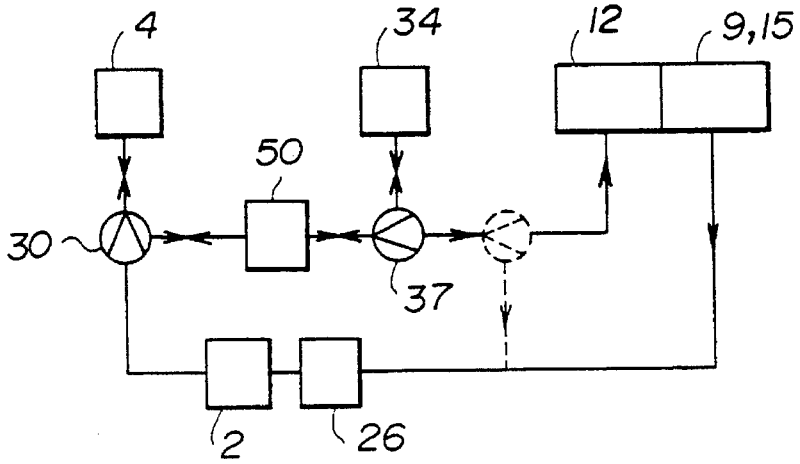
FIG. 12 is a diagram for explaining the sequence in which a recording medium sheet is transported in the apparatus shown in FIG. 11.

FIG. 12 shows the sequence in which the recording medium 5 is transported in the apparatus shown in FIG. 11. The sequence of the fifth embodiment indicates, as shown in FIG. 12, that the sheet holding part 34 between the sheet supplying part 1 and the display unit 4, and the selecting lever 37 between the erasing member 50 and the sheet holding part 34 are included in addition to that of the third embodiment shown in FIG. 8.

Figure 13:
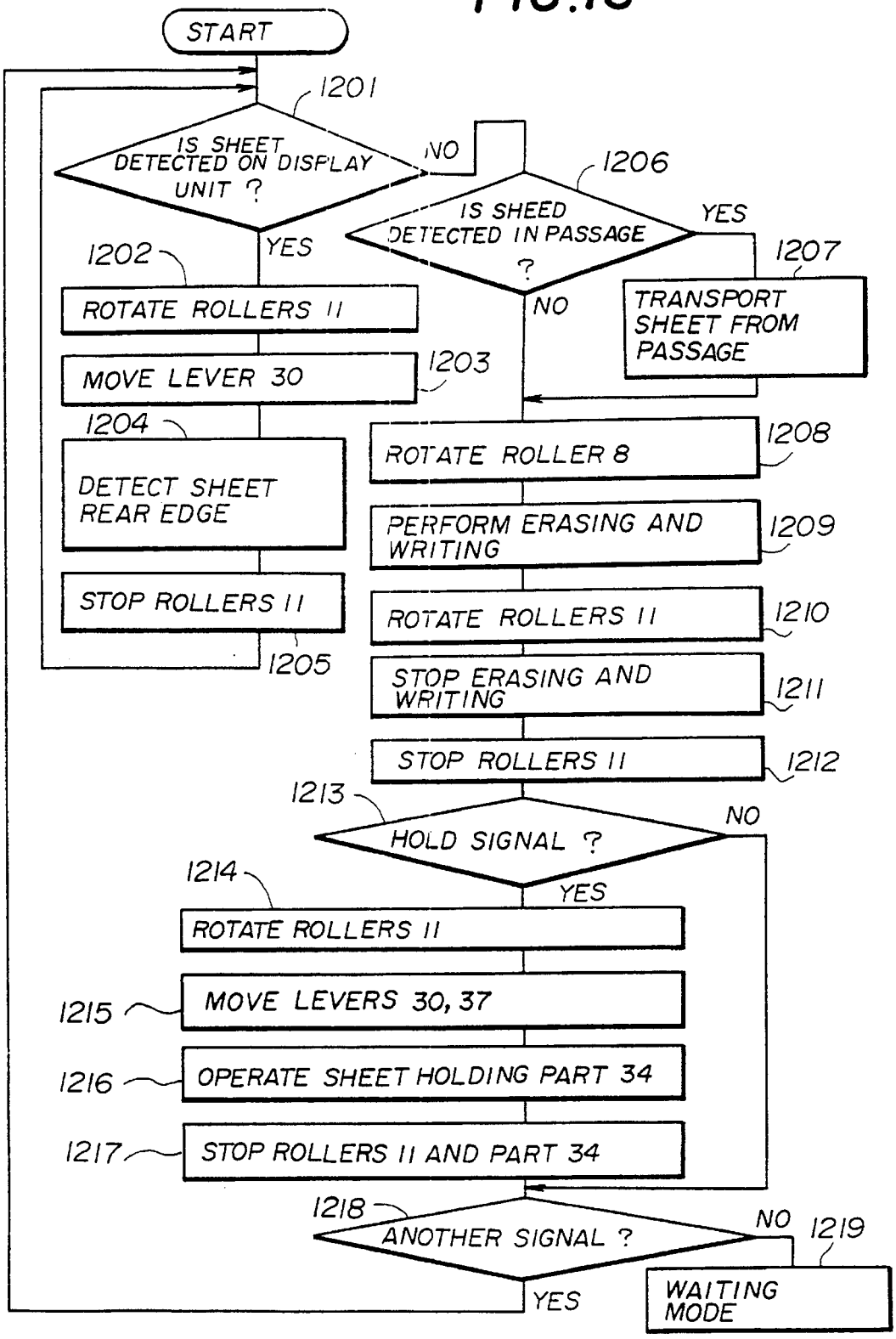
FIG. 13 is a flow chart for explaining the operation of the apparatus shown in FIG. 11.

FIG. 13 shows the operation of the fifth embodiment of the present invention. As described previously, the operation starts when a record signal from an external terminal is input to the image output apparatus which is in a waiting mode after turning ON the power switch of the apparatus. Step 1201 detects whether or not a recording medium 5 (also called a sheet) is displayed on the display unit 4.

If the sheet is displayed on the display unit 4, the sheet will be transported from the display unit 4 to the sheet supplying unit 1. Step 1202 rotates the pressure rollers 11 in order to transport the sheet from the display unit 4 to the recording unit 3. Step 1203 moves the selecting lever 30 to the given position, at the same time as the rotation of the rollers 11, in order to transport the sheet to the sheet supplying unit 1. Step 1204 detects that the rear edge of the sheet has passed the selecting lever 30. Step 1205 stops the rotation of the pressure rollers 11. The step 1201 described above is again performed.

If step 1201 detects no sheet on the display unit 4, step 1206 detects whether or not a sheet is present in any passage of the apparatus by means of the sensor of each passage. If a sheet is detected in a passage, step 1207 transports the sheet from the passage to a subsequent passage by rotating the corresponding roller. If no sheet is detected, the next step 1208 is performed without performing the step 1207 described above.

Step 1208 rotates the feeding roller (8 or 14) of the sheet supplying unit 1 in order to feed another recording medium 5 to the sheet feeding passage 21 of the recording unit 3. Step 1209 drives the erasing member 26 and the writing member 2 so that the sheet is subjected to the erasing of the erasing member 26 and to the writing of the writing member 2. After the leading edge of the sheet passes through the writing member 2, step 1210 rotates the pressure rollers 11 in order to transport the sheet from the recording unit 3 to the display unit 4. After the sheet is displayed on the display unit 4, step 1211 stops the operation of the erasing member 26 and the operation of the writing member 2. Step 1212 stops the rotation of the pressure rollers 11.

After the sheet is displayed, step 1213 detects whether or not a hold signal (used to hold the sheet from the display unit 4 in the part 34) is received by the sheet holding part 34. If the hold signal is received, step 1214 rotates the pressure rollers 11 in order to transport the sheet from the display unit 4 to the sheet holding part 34. At the same time, step 1215 moves the selecting lever 30 and the second selecting lever 37 so as to allow the sheet to be sent to the holding rollers 38 leading to the sheet holding part 34. After the sheet is placed into the sheet holding part 34 by means of the holding rollers 38, step 1216 operates the sheet holding part 34 such that each sheet is held by the sheet holding part 34. After the rear end of the sheet passes the selecting lever 30, step 1217 stops the rotation of the rollers 11. After the sheet is held by the sheet holding part 34, step 1217 stops the operation of the sheet holding part 34. Then, the next step 1218 is performed.

If step 1213 detects no hold signal received, step 1218 detects whether or not another record signal is received. If no signal is received, step 1219 performs no action so as to place the apparatus in a waiting mode. If another record signal is received in step 1218, the step 1201 described above is performed.

Figure 14:
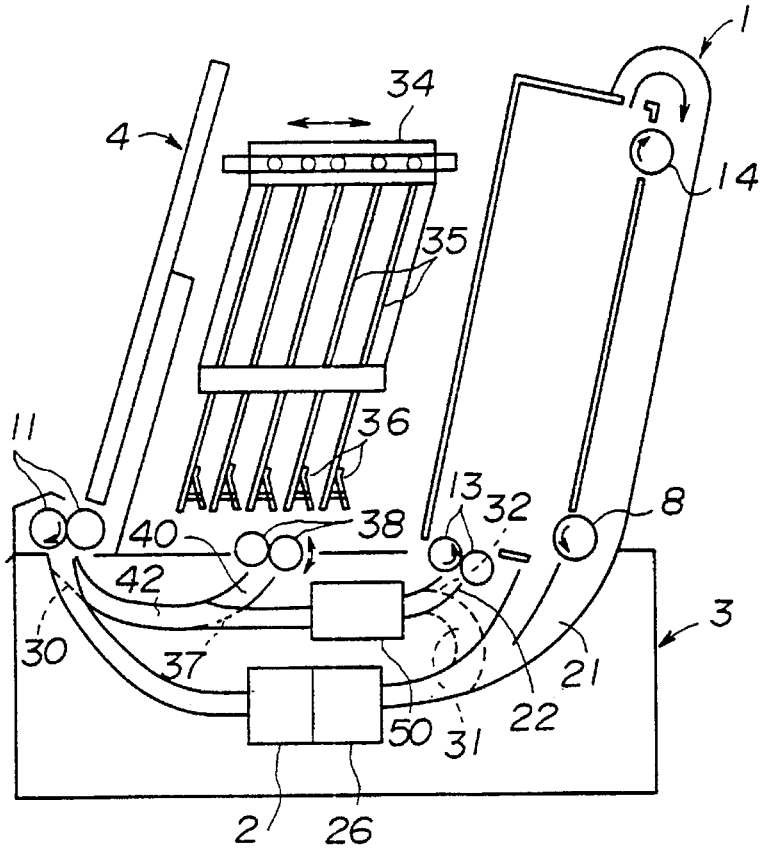
FIG. 14 is a sectional view showing a sixth embodiment of the present invention.
Figure 15:
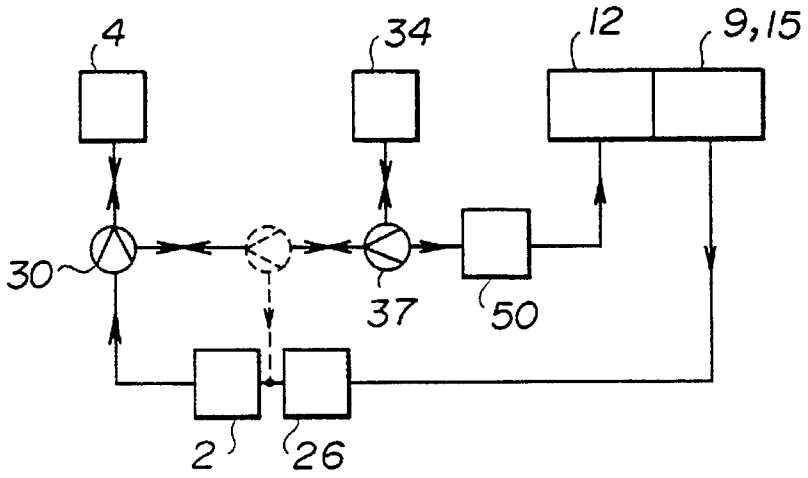
FIG. 15 is a diagram for explaining the sequence in which a recording medium sheet is transported in the apparatus shown in FIG. 14.

FIG. 14 shows a sixth embodiment of the present invention. In the apparatus shown in FIG. 14, the second erasing member 50 is located at a portion of the sheet reception passage 22 between the second selecting lever 37 and the sheet reception roller 13. The remaining construction of the apparatus shown in FIG. 14 is the same as that of the fifth embodiment described above. By means of the second erasing member 50 shown in FIG. 14, the erasing of image data can be performed for a recording medium 5 sent from the display unit 4 to the sheet supplying unit 1. FIG. 15 shows the sequence in which the recording medium 5 is transported in the sixth embodiment shown in FIG. 14.

Figure 16:
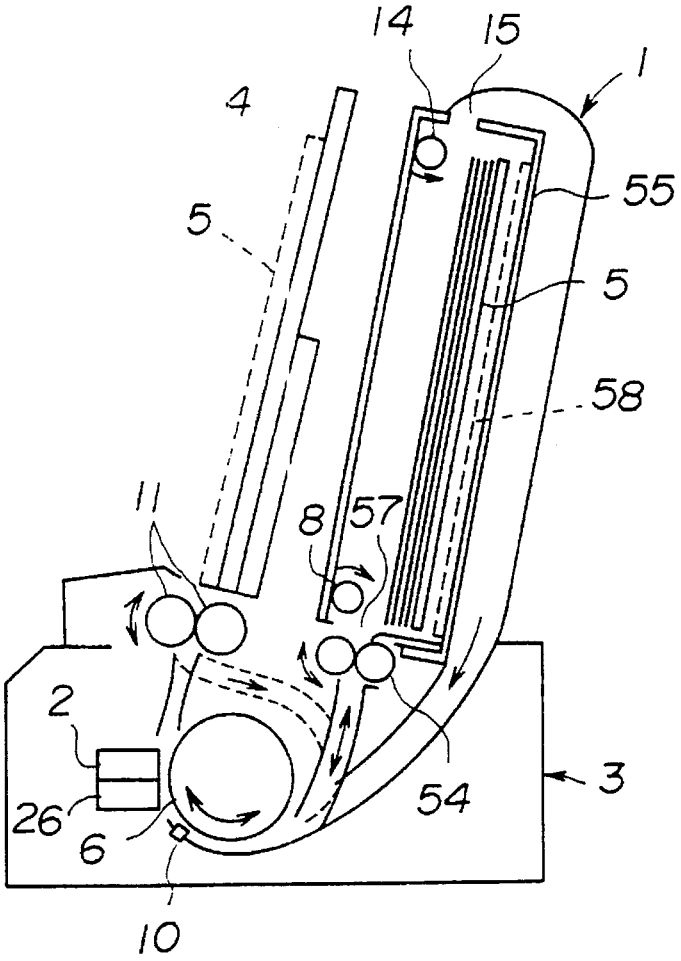
FIG. 16 is a sectional view showing a seventh embodiment of the present invention.

FIG. 16 shows a seventh embodiment of the present invention. In the apparatus shown in FIG. 16, a sheet ejection/reception opening 57, a pair of ejection/reception rollers 54, a supporting member 55, and a pressure member 58 are provided. The first ejection opening 9 and the sheet reception opening 12 in the apparatus shown in FIG. 4 are formed into one common opening in the seventh embodiment shown in FIG. 16. The remaining construction of the apparatus shown in FIG. 16 is the same as that of the second embodiment shown in FIG. 4.

In the apparatus shown in FIG. 16, a recording medium 5 is supplied to and received from the recording unit 3 via the sheet ejection/reception opening 57 of the sheet supplying unit 1. A recording medium 5 with its front surface down (the normal condition) is supplied from the sheet supplying unit 1 via the opening 57 (located at the bottom portion of the unit 1) by rotation of the roller 8 and the ejection/reception rollers 54. Also, a recording medium 5 with its front surface up (the inverted condition) is supplied from the sheet supplying unit 1 via the second ejection opening 15 (located at the top portion of the unit 1) by rotation of the roller 14. The pressure member 58 is provided in the sheet supplying unit 1 between the recording medium 5 and the supporting member 55. Obviously, the structure of the sheet supplying unit 1 shown in FIG. 16 can be applied to the other embodiments described above.

Figure 17:
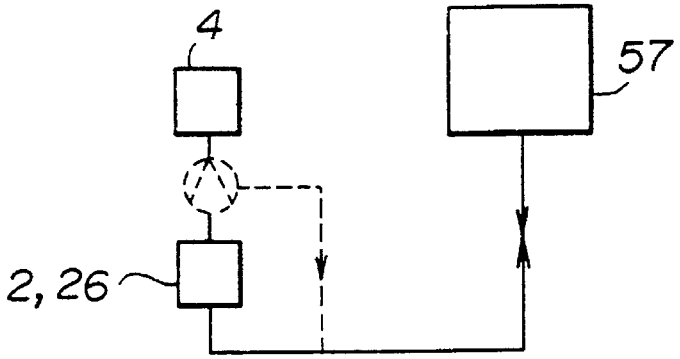
FIG. 17 is a diagram for explaining the sequence in which a recording medium sheet is transported in the apparatus shown in FIG. 16.

FIG. 17 shows the sequence in which the recording medium 5 is transported in the seventh embodiment shown in FIG. 16. In the sequence shown in FIG. 17, the first ejection opening 9, the second ejection opening 15, and the sheet reception opening 12 are replaced by the sheet ejection/reception opening 57 as a common opening.

Figure 18:
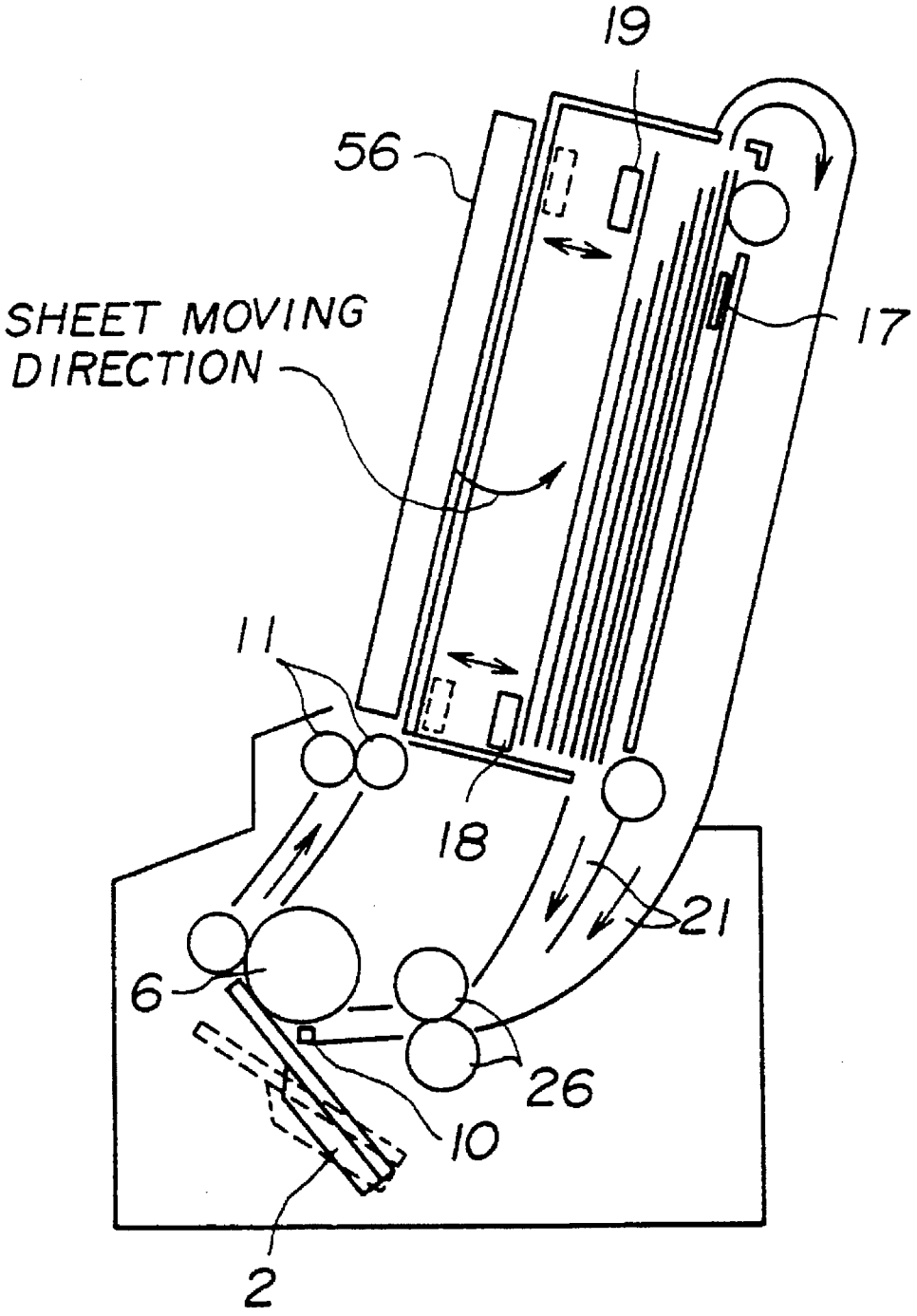
FIG. 18 is a sectional view showing an eighth embodiment of the present invention.
Figure 19:
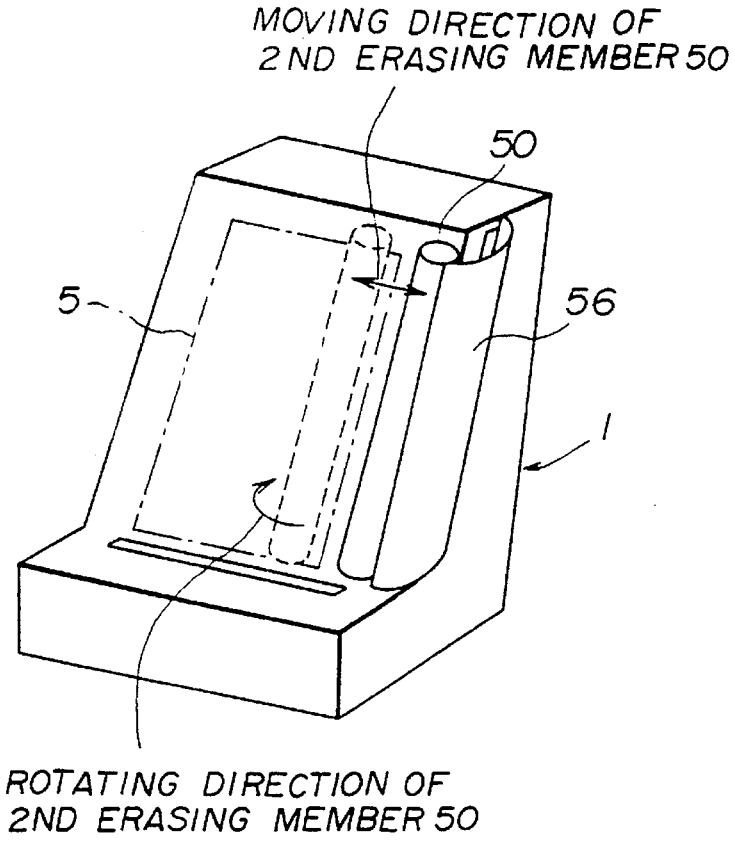
FIG. 19 is a diagram showing the moving and rotating directions of a second erasing member of the apparatus shown in FIG. 18.
Figure 20:
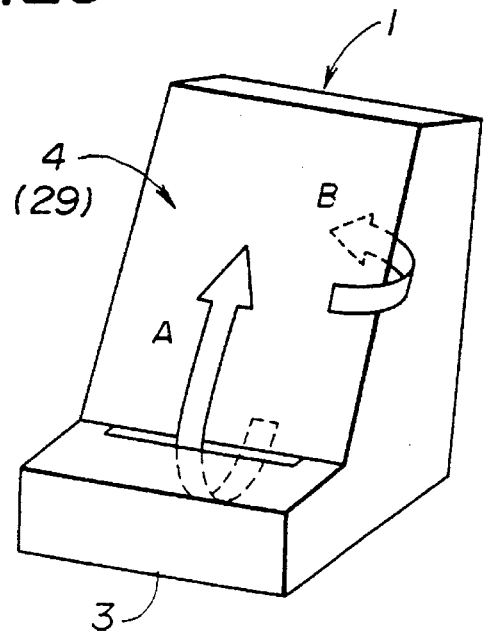
FIG. 20 is a diagram showing the moving directions of a recording medium sheet in the apparatus shown in FIG. 18.

FIGS. 18–20 show an eighth embodiment of the present invention. In the eighth embodiment, the covering plate 29 of the sheet supplying unit 1 is formed integrally with the displaying unit 4. In this image output apparatus, as shown in FIG. 19, the second erasing member 50 is located at a side portion of a front surface of the display unit 4. The pressure rollers 11 shown in FIG. 18 are rotated only in a direction so as to upwardly transport the recording medium 5 from the recording unit 3 to the displaying unit 4. The second erasing member 50 serves to erase all the information on a recording medium sheet only when the sheet is supplied from the display unit 4 to the sheet supplying unit 1. The second erasing member 50 is a heating member for heating the recording medium 5 so as to erase information from the recording medium 5 or coloring the entire sheet of the recording medium 5. When the second erasing member 50 does not heat the recording medium 5, the second erasing member 50 serves as a guide member for guiding the movement of the recording medium 5.

As shown in FIG. 19, the second erasing member 50 is moved by a drive mechanism (not shown) in a lateral direction while it is rotated around the central axis of the second erasing member 50, so that the information on the entire sheet of the recording medium 5 is erased. FIG. 20 shows the moving directions of the recording medium 5 when it is transported in the apparatus shown in FIG. 18. The vertical direction indicated by the arrow "A" in FIG. 20 is the moving direction in which a recording medium 5 from the sheet supplying unit 1 is transported to the front surface of the displaying unit 4 via the recording unit 3. The horizontal direction indicated by the arrow "B" in FIG. 20 is the moving direction in which a recording medium 5 on the front surface of the displaying unitt 4 is transported to the sheet supplying unit 1. The vertical direction of the movement of the recording medium 5 changes on the front surface of the display unit 4 to the horizontal direction, and then the recording medium 5 is placed into the sheet supplying unit 1.

Figure 21:
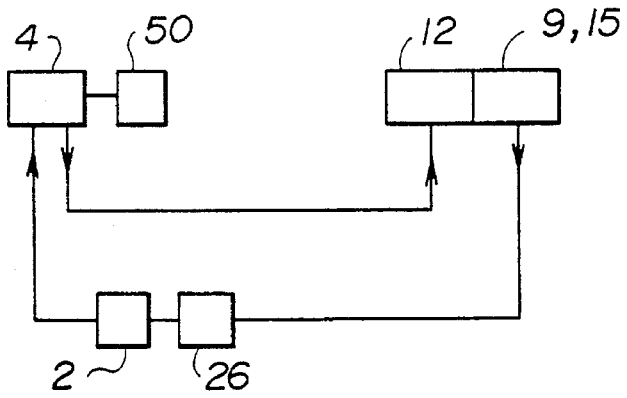
FIG. 21 is a diagram for explaining the sequence in which a recording medium sheet is transported in the apparatus shown in FIG. 18.

FIG. 21 shows the sequence in which a recording medium 4 is transported in the apparatus shown in FIGS. 18–20. In the sequence shown in FIG. 21, two passages extending from the display unit 4 indicate that the recording medium 5 is transported in the vertical direction from the unit 1 to the unit 4, and that the recording medium 5 is transported in the horizontal direction from the displaying unit 4 to the sheet supplying unit 1.

Figure 22:
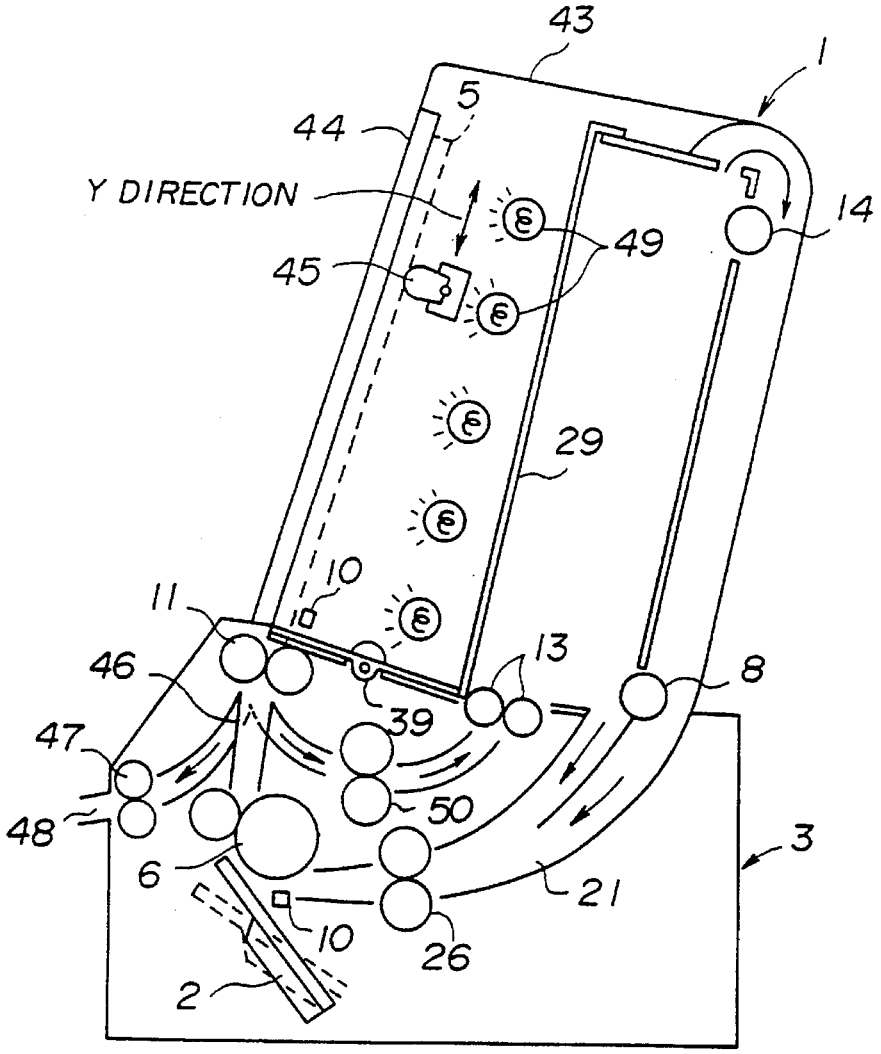
FIG. 22 is a sectional view showing a ninth embodiment of the present invention.

FIG. 22 shows a ninth embodiment of the present invention. In the apparatus shown in FIG. 22, the display unit 4 including several parts is accommodated in a frame 43. On the front surface of the frame 43 of the display unit 4, a transparent display window 44 is formed. The recording medium 5 is placed on the reverse surface of the display window 44 when it is displayed. A movable writing member 45 is supported on a guiding member of the displaying unit 4 so as to write information to the reverse surface of the recording medium 5 when the recording medium 5 is displayed on the displaying unit 4. A plurality of illuminating lamps 49 are provided between the guiding member of the writing member 45 and the covering plate 29 to illuminate the recording medium 5 from the reverse surface thereof.

In the recording unit 3 shown in FIG. 22, a selecting lever 46, a pair of ejection rollers 47, and a sheet ejection opening 48 are provided in a passage of the recording unit 3 extending from the pressure rollers 11. In the ninth embodiment shown in FIG. 22, a recording medium 5 from the sheet supplying unit 1 is transported to the writing member 2, and the sheet from the writing member 2 is transported to the display unit 4. The recording medium 5 from the display unit 4 is returned back to the sheet supplying unit 1 via the second erasing member 50.

Figure 23:
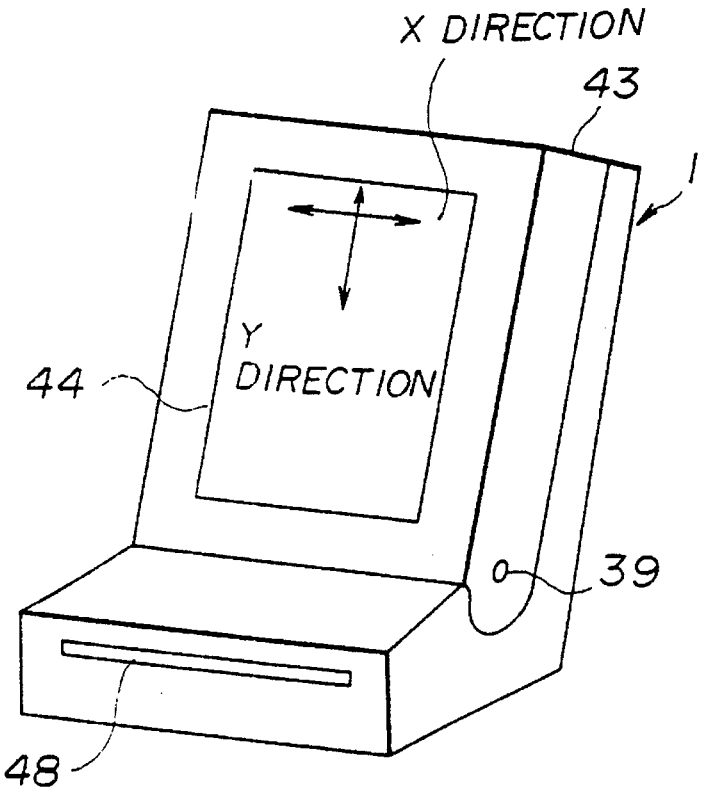
FIGS. 23 and 24 are diagrams showing the upright and inclined conditions of a frame of a display unit of the apparatus shown in FIG. 22.
Figure 24:
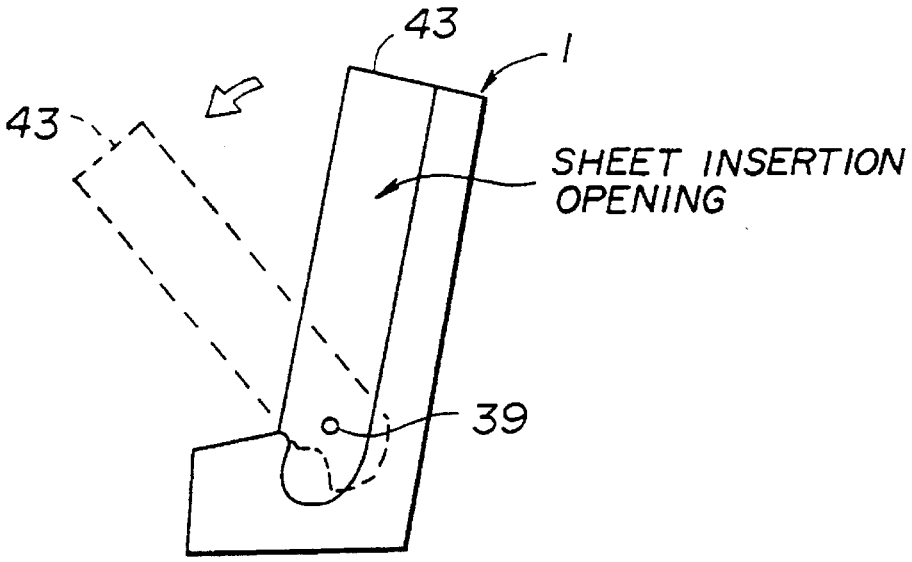

As shown in FIG. 23, in the ninth embodiment, a transversely extending supporting shaft 39 at a bottom portion of the frame 43 is provided, and the frame 43 of the display unit 4 is rotatably supported on the recording unit 3 by the supporting shaft 39. When the sheet supplying unit 1 is replenished with new sheets of the recording medium 5, the frame 43 is made to incline forwards by pivoting around the shaft 39 into the position indicated by the dotted line in FIG. 24, so that the inside of the sheet supplying unit 1 is exposed allowing the new sheets to be easily placed into the sheet supplying unit 1.

In order to display the recording medium 5 on the display unit 4, the recording medium 5 is loosely or snugly fitted on the reverse surface of the display window 44. The recording medium 5 is placed such that a transparent protecting layer of the recording medium 5 comes into contact with the display window 44. The movable writing member 45 comes into contact with the reverse surface of the recording medium 5 to write information to the recording medium 5 through a reverse-side opaque protecting layer thereof.

The writing member 45 is moved relative to the stationary recording medium 5 in both X and Y directions shown in FIG. 23 in accordance with a record signal sent upon a request from an operator. A marking used to detect a write-start position is printed, in advance, to a prescribed position of the recording medium 5. By sensing the position of this marking, the writing member 45 can write information to the recording medium 5 at the correct position.

When the recording medium 5 is displayed, it is illuminated by the illuminating lamps 49 from the reverse surface thereof. Thus, the image on the recording medium 5 can readily be seen by the operator. The opaque protecting layer of the recording medium 5 serves as the diffusion surface, and the light emitted from the lamps 49 does not shine directly into the eyes of the operator. In order to eject the recording medium 5 from the display unit 4 to the outside, the selecting lever 46 is moved to a given position so as to transport the sheet 5 to the ejection rollers 47 by rotation of the pressure rollers 11. The sheet 5 is ejected to the sheet ejection opening 48 by rotation of the rollers 47. The selecting lever 46 is normally placed in another position in order to transport the sheet from the display unit 4 to the sheet supplying unit 1.

Next, a description will be given of other sequences in which the recording medium 5 is transported in the apparatus of the present invention.

Figure 25:
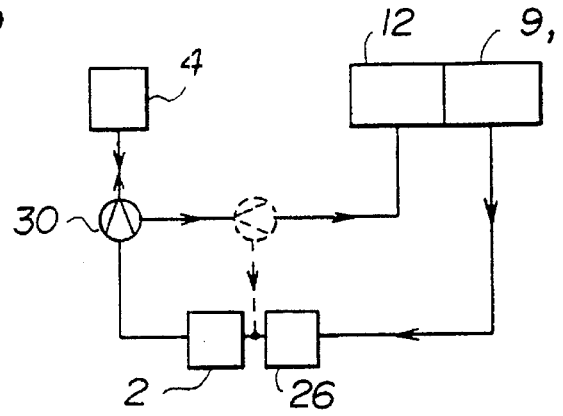
FIGS. 25 through 31 are diagrams for explaining other sequences in which a recording medium sheet is transported in the apparatus according to the present invention.
Figure 26:
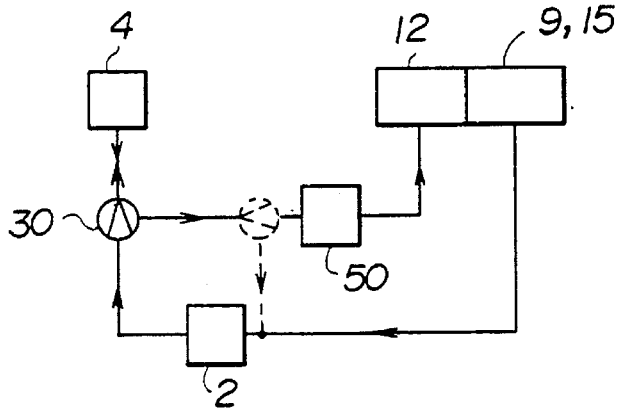

FIG. 25 shows the sequence in which a recording medium 5 is transported in the third embodiment shown in FIG. 7 in which the second erasing member 50 is eliminated from the apparatus. FIG. 26 shows the sequence in which a recording medium 5 is transported in the third embodiment shown in FIG. 7 in which the erasing member 26 is eliminated from the apparatus. When the recording medium 5 is frequently displayed on the display unit 4 and frequently transported to the sheet supplying unit 1, the processing utilizing the sequence shown in FIG. 25 can be more quickly performed by the apparatus.

Figure 27:
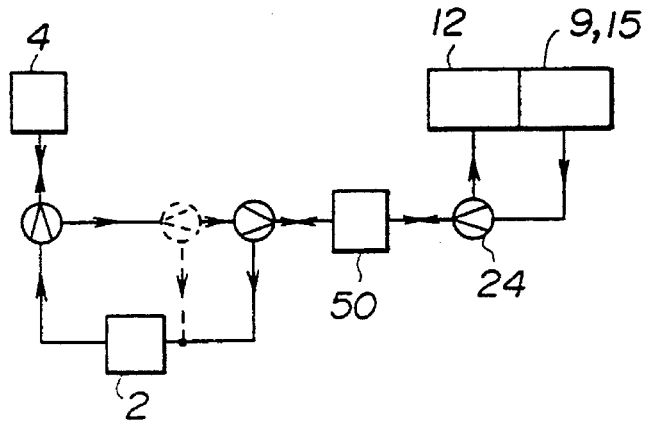

FIG. 27 shows the sequence in which a recording medium 5 is transported in the third embodiment in which the erasing member 26 is eliminated from the apparatus, and in which an additional passage between the writing member 2 and the second erasing member 50 is provided. The operation of the apparatus in this case is performed in accordance with the operation shown in FIG. 13 in which the steps 1213–1217 are omitted.

Figure 28:
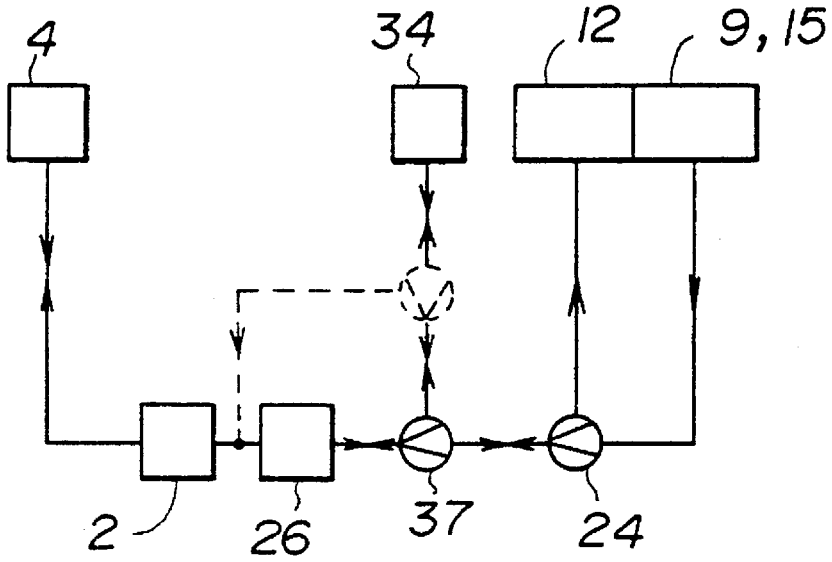
Figure 29:
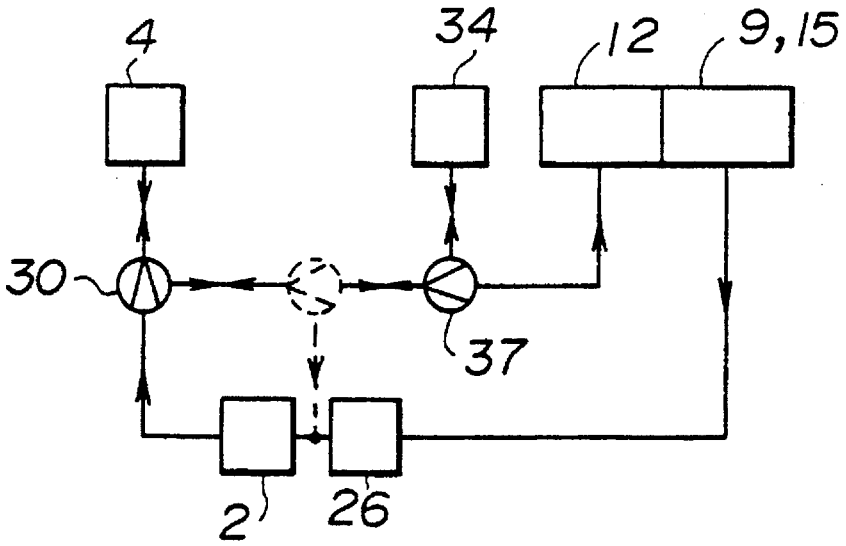
Figure 31:
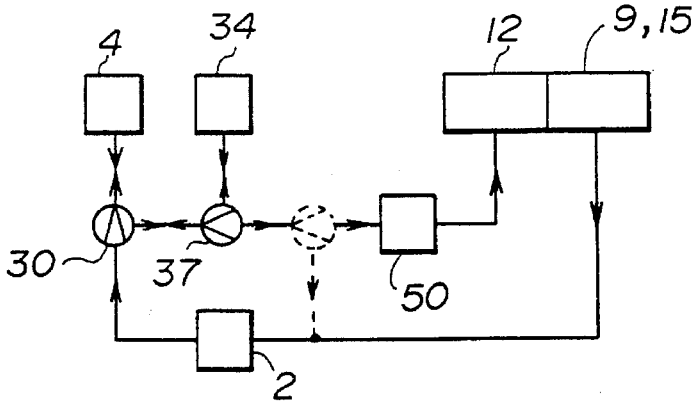

FIG. 28 shows the sequence in which a recording medium 5 is transported in the fifth embodiment in which the return passage 42 and the second erasing member 50 are eliminated, and in which a common passage between the display unit 4 and the sheet holding unit 34 is provided. The recording medium 5 when it is transported passes through the writing member 2 and the erasing member 26. FIG. 29 shows the sequence in which a recording medium 5 is transported in the fifth embodiment in which the second erasing member 50 is eliminated from the apparatus. FIG. 31 shows the sequence in which a recording medium 5 is transported in the sixth embodiment in which the erasing member 26 is eliminated from the apparatus.

Figure 30:
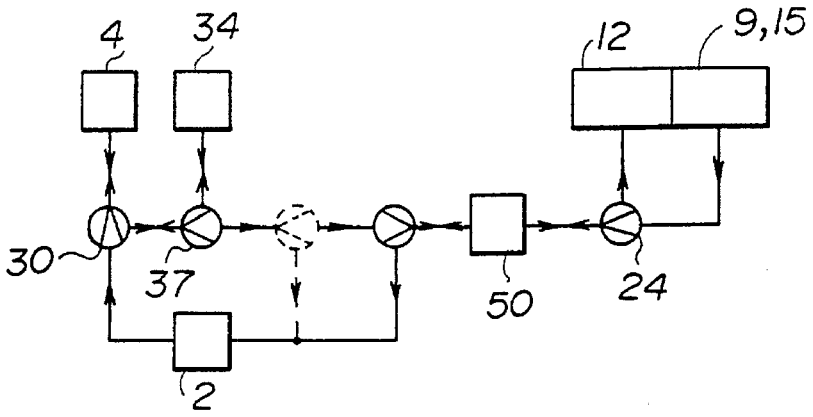

FIG. 30 shows the sequence in which a recording medium 5 is transported in the sixth embodiment in which the erasing member 26 is eliminated from the apparatus, and an additional passage between the writing member 2 and the second erasing member 50 is provided. The operation of the apparatus in this case is performed in accordance with the operation shown in FIG. 13 in which the steps 1213–1217 are omitted.

In the sequences shown in FIGS. 25–31, it is possible to write information to the recording medium 5 again after it is transported to and returned from the displaying unit 4, by providing a sheet passage and a selecting lever indicated by a dotted line in these drawings in the apparatus.

Figure 32:
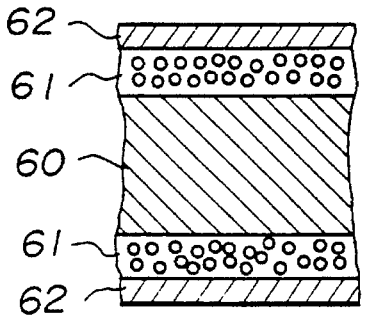
FIG. 32 is a sectional view showing the structure of a thermochromic recording medium sheet used by the apparatus according to the present invention.

Next, a description will be given of the recording medium 5 used by the apparatus according to the present invention. FIG. 32 shows the cross-sectional structure of a thermochromic recording medium sheet used by the apparatus of the present invention. As shown in FIG. 32, this recording medium sheet is formed so as to include a supporting layer 60, a first thermochromic layer 61 supported on the supporting layer 60, a second thermochromic layer 61 supported on the supporting layer 60, a first protecting layer 62 on top of the first thermochromic layer 61, and a second protecting layer 62 on bottom of the second thermochromic layer 61. Either the supporting layer 60 or one of the protecting layers 62 is made of an opaque material, and the other layers are made of transparent materials.

In the recording medium sheet shown in FIG. 32, each of the thermochromic layers 61 is colored to a different color when heated. The two colors of image of the thermochromic layers 61 of the recording medium sheet on the opaque layer background can be seen from the transparent protecting layer on the opposite side of the sheet. In order to describe image data (written to the sheet) in four colors (e.g., blue, green, red, black), the above recording medium sheet is used in combination with a transparent recording medium sheet having two thermochromic layers, in a two-sheet form.

In a thermochromic material used in the recording medium sheet described above, a low-level organic compound (such as a higher fatty acid) mixed in a polymer resin solvent is applied to a substrate, and dried so that an organic compound film is produced. The organic compound having particles of the size less than 1 micron is deposited and dispersed in the resin in accordance with the film production conditions. The crystal phase of the organic compound of the thermochromic material varies in accordance with the temperature to which it is heated. The thermochromic material becomes colored (or opaque) and uncolored (transparent) in accordance with the temperature. Once image data is written to the recording medium sheet, the recorded data in the sheet is retained even when it is cooled to normal room temperature.

Figure 33:
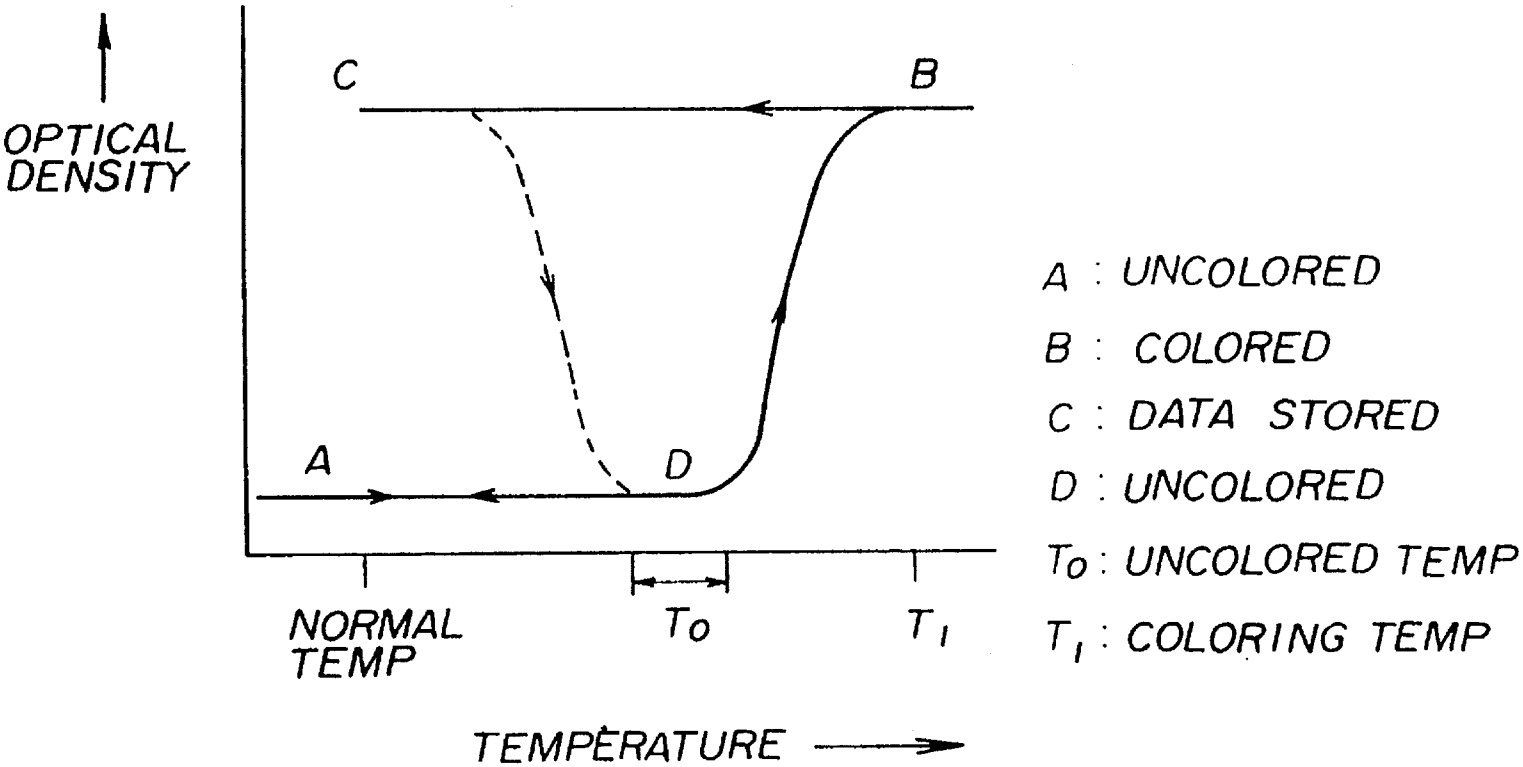
FIG. 33 is a chart showing the thermochromic characteristic of a recording medium sheet shown in FIG. 32.

FIG. 33 shows a thermochromic characteristic of the recording medium sheet shown in FIG. 32. The characteristic of the coloring type sheet shown in FIG. 33 indicates a characteristic relationship between the optical density of the thermochromatic material and the heating temperature. However, there is another type of material, which is white at normal room temperature and turns transparent when heated to a prescribed temperature.

The thermochromic material shown in FIG. 33 is in an uncolored condition as indicated by the letter "A" in FIG. 33 at a normal temperature. If the thermochromic material is heated to a coloring temperature "T1", the optical density of the material becomes higher and reaches a level indicated by the letter "B" (the material at this time becomes colored). If the material is cooled from the temperature "T1" to a normal temperature, the optical density of the thermochromic material is maintained at a level equal to that of the colored condition "B". The thermochromic material is thus in a data storage condition indicated by the letter "C" in FIG. 33. If the material which was in the data storage condition "C" is heated to an uncolored temperature "To", the optical density of the material decreases and the material enters an uncolored condition indicated by the letter "D" in FIG. 33. The recording medium sheet used by the image output apparatus has the thermochromic characteristic as mentioned above.

The supporting layer 60 of the recording medium may be paper, synthetic resin, or a plastic film. Preferably the supporting layer 60 is made of a plastic film which has good flexibility, can be perforated to make holes for filing purposes, and has tensile strength and water resistance for repeated use. As shown in FIG. 32, the thermochromic layer 61 is formed on top of the supporting layer 60 through spraying or vacuum evaporation of a thermochromic material. The protecting layer 62 is formed on top of the thermochromic layer 61. The recording medium sheet having the thus formed structure is cut to a standard A4 or B4 size. Either the supporting layer 60 or one of the protecting layers 62 is made of an opaque material. The opaque material is produced by mixing $TiO_2$ particles or forming an irregularly diffusing surface of the layer.

Figure 34:
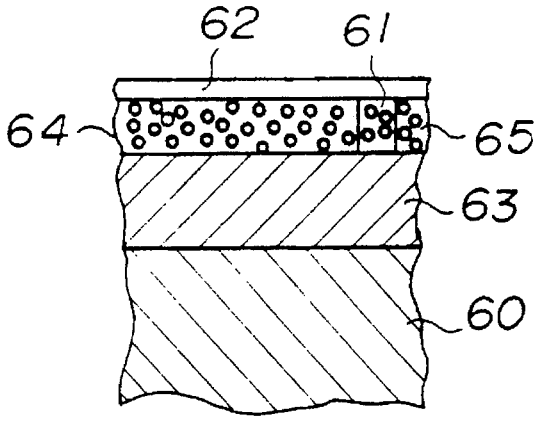
FIG. 34 is a sectional view showing the structure of another thermochromic recording medium sheet used by the apparatus according to the present invention.

FIG. 34 shows the cross-sectional structure of another thermochromic recording medium sheet used by the image output apparatus according to the present invention. The thermochromic recording medium sheet shown in FIG. 34 has a naturally uncoloring characteristic. As shown in FIG. 34, the recording medium sheet is formed to have a supporting layer 60, a heat holding layer 63 supported on top of the supporting layer 60, a thermochromic layer 61 formed on top of the heat holding layer 63, and a protecting layer 62 formed on top of the heat holding layer 63. The thermochromic layer 61 may be a third thermochromic layer 64 made of an erasable recording material having a naturally uncoloring characteristic. A fourth thermochromic layer 65 made of a non-erasable recording material if necessary may be formed at a suitable portion of the recording medium sheet to store a maintenance data of the sheet which data is not to be erased.

The thermochromic recording medium sheet shown in FIG. 34 is made up of four major components: a leuco material having an electron supplying capability, an uncoloring agent such as a phenol compound having an electron donor capability, a binding agent, and an appropriate amount of an additive.

Examples of materials which can be used as the leuco material of the thermochromic recording medium sheet of the present invention are: 3-cyclohexylamino-6-chlorofluorene, 3-cyclohexylamino-6-bromofluorene, 3-diethylamino-7-chlorofluorene, 3-diethylamino-7-bromofluorene, 3-dipropylamino-7-chlorofluorene, 3-diethylamino-6-chloro-phenylaminofluorene, 3-pyrrolidino-6-chloro-phenylaminfluorene, 3-diethylamino-6-chloro-(m-trifluoromethylphenyl)aminfluorene, 3-cyclohexylamino-6-chloro-(o-chlorpnenyl) aminofluorene, 3-diethylamino-6-chloro-(2',3 '-dichlorphenyl)aminofluorene 3-diethylamino-6-methyl-7-chlorofluorene, 3-dibutylamino- 6-chloro-7-ethoxiethylaminofluorene, 3-diethylamino- 7-(o-chlorphenyl)aminofluorene, 3-dibuthylamino- 7-(o-fluorphenyl)aminofluorene, 6'-bromo-3'-methoxibenzoyndrinopyrirospylene, 3-(2'-methoxyl-4'-dimethylaminophenyl)-3-(2'-hydroxyl-4'-chloro-5 '-chlorophenyl)phthalide, 3-(2'-hydroxyl-4'-dimethylaminophenyl)- 3-(2'-methoxyl-5'-chlorophenyl) phthalide, 2-[3,6-bis-(diethylamino)]- 9-(o-chlorphenyl)aminoxanchyl)benzoate-lactam, 3-N-ethyl-N-isoamylamino-7-chlorofluorene, 3-diethylamino-6-methyl-7-m-trifluoromethylanilynofluorene, 3-pyrrolidino-6-methyl-7-m-trifluoromethylanilinofluorene, 3-(N-cyclohexyl-N-methyl)amino- 6-methyl-7-m-trifluoro-methylanilynofluorene, and 3-morpholyno-7-(N-n-propyl-N-m-trifluoromethylphenyl) aminofluorene.

Substances/materials which can be used as the uncoloring agent component of the recording medium sheet of the present invention are organic phosphate compounds indicated by the following chemical formula.

$$R—PO(OH)_2 \quad (1)$$

In this formula. "R" denotes an alkyl or alkenyl group including twelve or more carbon atoms in the form of a straight chain or a branched chain.

Examples of substances/materials, used as the uncoloring agent component, which are indicated by the above formula are: octyl-phosphonic acid, nonyl-phosphonic acid, decyl-phosphonic acid, dodecyl-phosphonic acid, tetradecyl-phosphonic acid, hexadecyl-phosphonic acid, octadecyl-phosphonic acid, eicosyl-phosphonic acid, decosal-phosphonic acid, and tetracosyl-phosphonic acid.

In addition, substances/materials which can be used as the uncoloring agent component of the recording medium sheet of the present invention are organic acids having a hydroxyl group at the alpha-position carbon, which are indicated by the following chemical formula.

$$R1—CH(OH)COOH \quad (2)$$

In this formula, "R1" denotes an alkyl or alkenyl group having twelve or more carbon atoms in the form of a straight chain or a branched chain.

Examples of the uncoloring agents indicated by the formula (2) are: alpha-hydroxy-octa-enoic acid, alpha-hydroxy-dodeca-enoic acid, alpha-hydroxy-tetradeca-enoic acid, alpha-hydroxy-hexadeca-enoic acid, alpha-hydroxy-octadeca-enoic acid, alpha-hydroxy-pentadeca-enoic acid, alpha-hydroxy-eicosa-enoic acid, and alpha-hydroxy-docosa-enoic acid.

In addition, substances/materials which can be used as the uncoloring agent component of the recording medium sheet of the present invention are dibasic organic acids indicated by the following chemical formula.

$$R2—Zm—\underset{\displaystyle CH_2—COOH}{\underset{|}{CH}}—COOH \quad (3)$$

In this formula, "R2" denotes an alkyl or alkenyl group having twelve or more carbon atoms in the form of a straight chain or a branched chain, "Z" denotes oxygen atom or sulfur atom, and "m" denotes an integer equal to 0, 1, or 2.

Examples of the uncoloring agents as mentioned above are: octyl-succinic acid, decyl-succinic acid, dodecyl-succinic acid, tetradecyl-succinic acid, hexadecyl-succinic acid, octadecyl-succinic acid, eicocyl-succinic acid, tetracocyl-succinic acid, octyl-malic acid, decyl-malic acid, dodecyl-malic acid, tetradecyl-malic acid, hexadecyl-malic acid, octadecyl-malic acid, eicocyl-malic acid, decocyl-malic acid, tetracocyl-malic acid, octyl-thiomalic acid, decyl-thiomalic acid, dodecyl-thiomalic acid, tetradecyl-thiomalic acid, hexadecyl-thiomalic acid, octadecyl-thiomalic acid, eicocyl-thiomalic acid, decocyl-thiomalic acid, tetracocyl-thiomalic acid, octyl-dithiomalic acid, decyl-dithiomalic acid, dodecyl-dithiomalic acid, tetradecyl-dithiomalic acid, hexadecyl-dithiomalic acid, octadecyl-dithiomalic acid, eicocyl-dithiomalic acid, decocyl-dithiomalic acid, and tetracocyl-dithiomalic acid.

Moreover, substances/materials which can be used as the uncoloring agent component of the recording medium sheet of the present invention are dibasic acids indicated by the following chemical formula.

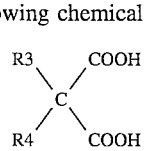

(4)

In this formula, "R3" denotes an alkyl or alkenyl group having twelve or more carbon atoms in the form of a straight chain or a branched chain, and "R4" denotes an alkyl group having one through thirty hydrogen atoms or carbon atoms.

Examples of the uncoloring agents as mentioned above are: octyl-malonic acid, decyl-malonic acid, dodecyl-malonic acid, tetradecyl-malonic acid, hexadecyl-malonic acid, octadecyl-malonic acid, eicocyl-malonic acid, decocyl-malonic acid, tetracocyl-malonic acid, dioctyl-malonic acid, didecyl-malonic acid, didodecyl-malonic acid, ditetradecyl-malonic acid, dihexadecyl-malonic acid, dioctadecyl-malonic acid, dieicocyl-malonic acid, didecocyl-malonic acid, methyl-octadecyl-malonic acid, methyl-eicocyl-malonic acid, methyl-decocyl-malonic acid, methyl-tetracocyl-malonic acid, ethyl-octadecyl-malonic acid, ethyl-eicocyl-malonic acid, ethyl-decocyl-malonic acid, and ethyl-tetracocyl-malonic acid.

Examples of materials/substances which can be used as the binding agent component of the recording medium sheet of the present invention are: polyvinyl alcohol, hydroxyethyl cellulose, hydroxypropyl cellulose, methoxyl cellulose, carboxymethyl cellulose, methyl cellulose, cellulose acetate, gelatin, casein, starch, polyacrylic soda, polyvinylpyrrolidone, polyacrylic amid, maloic copolymer, acrylic copolymer, polystyrene, polyvinyl chloride, polyvinyl acetate, polyacrylic ester, polymethacrylic ester, vinyl-chloride/vinyl-acetate copolymer, styrene copolymer, polyester, and polyurethane.

In order to control the uncoloring time of the recording medium sheet, a certain amount of additive is added to the thermochromic layer 61 of the recording medium sheet. Examples of substances/materials which can be used as the additive component of the recording medium sheet of the present invention are: phthalate ester, fatty acid ester, phosphate, carnauba wax, paraffin wax, beeswax, polyethylene wax, dimethyl silicone oil, polyether silicone oil, epoxy silicone oil, anionic, nonionic or cationic surface active agent, lauryl alcohol, and stearyl alcohol.

Generally, the uncoloring time of the recording medium sheet after the sheet is heated for writing varies depending on the weight ratio of the additive of the thermochromic layer 61 relative to the uncoloring agent. For example, when the weight ratio of the additive to the uncoloring agent is 5%, the recording medium sheet becomes uncolored about 24 hours after it was heated for the writing. When the weight ratio of the additive is 10% the recording medium sheet becomes uncolored about five hours after being heated. When the weight ratio of the additives is 20%, the recording medium sheet becomes uncolored about one hour after being heated.

Next, a description will be given of a method of producing the recording medium sheet shown in FIG. 34. To obtain a suitable composition ratio, 50 g of 3-diethylamino-7-(o-chlorophenyl)aminofluorene, 150 g of vinyl-chloride/vinyl-acetate copolymer, and 10 g of dioctyl phthalate are mixed. The mixture mentioned above is ground into particles of a size less than 3 microns, and 1350 g of toluene/MEK (methyl ethyl ketone) (=1/1) solvent is added so that a source material liquid is produced. The source material liquid mentioned above is coated onto a 75-micron-thick PET (polyethylene terephthalate) film to form a thermochromic layer 61 about 5 microns thick on the PET film. After the layer 61 dries at 80 deg. C, urethane acrylate resin is coated onto the thermochromic layer 61 of the PET film to form a layer about 3 microns thick on the layer 61. After it dries at 80 deg. C, the layer of urethane acrylate resin is cured by the exposure to an ultraviolet lamp.

Figure 35:
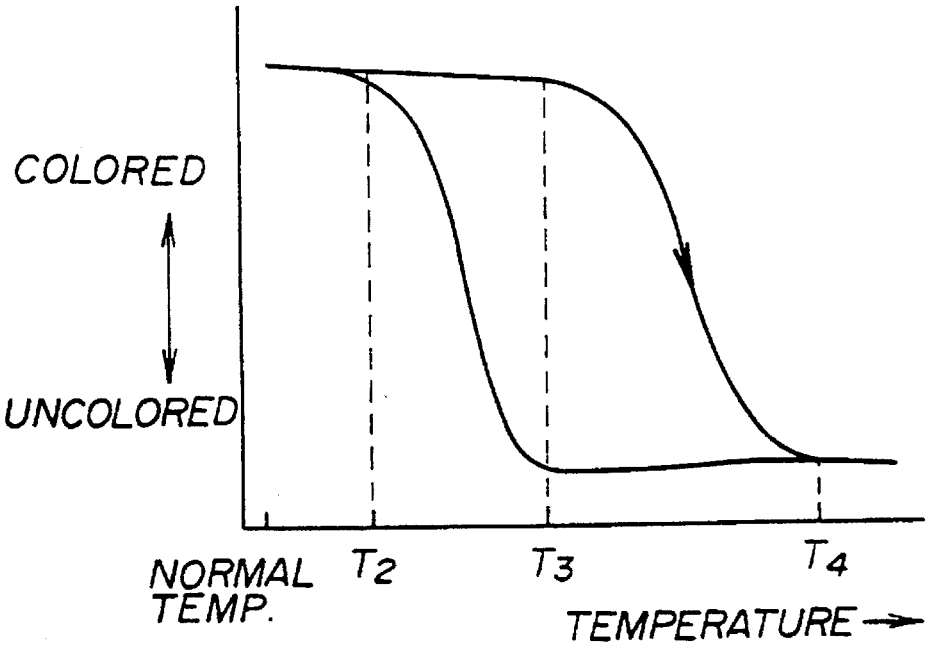
FIG. 35 is a chart showing the thermochromic characteristic of a recording medium sheet shown in FIG. 34.

FIG. 35 shows a thermochromic characteristic of the recording medium sheet shown in FIG. 34. As shown in FIG. 35, when the recording medium sheet is heated to a temperature higher than "T4", it becomes uncolored. In the case of the recording medium sheet shown in FIG. 34, when the sheet is naturally cooled to a temperature higher than "T2", the sheet is in the colored condition so that image data written to the sheet is maintained. If the temperature level "T3" shown in FIG. 35, which varies depending on the material of the sheet, is around normal temperature, the image data (written to the sheet when heated) can be maintained for a relatively long time. If the temperature level "T2" is higher than normal temperature, the image data (written to the sheet when heated) naturally disappears from the sheet when it stands at normal temperature. In order to maintain the image data on the recording medium sheet for a relatively long time, a relatively thick heat holding layer 63 is formed between the supporting layer 60 and the thermochromic layer 61. The heat of the thermochromic layer 61 when the sheet stands at normal temperature can be maintained due to a relatively thick heat holding layer 63.

If a number of recording medium sheets 5 large enough to maintain the heat of the thermochromic layer 61 are placed in the sheet supplying unit 1, and information is written to the recording medium sheet after the uncolored time has elapsed, it is not necessary to provide the erasing member for erasing information of the sheet in the image output apparatus.

If the recording medium sheet having the third thermochromic layer 64 made of an erasable recording material is used, the fourth thermochromic layer 65 made of a non-erasable recording material may be formed at corner portions of the sheet or the others, in order to record maintenance data indicating the total number of writings for evaluating the operating life of the sheet. Each time the data is written to the recording medium sheet, the maintenance data of the fourth thermochromic layer 65 is incremented.

In order to locate the recording medium sheet in the apparatus for writing information at a correct position on the sheet, a marking is recorded at a prescribed position on the sheet. This marking is sensed by the writing position sensor 10, so that information is accurately written to the correct position on the sheet by any of the writing members 2, 45, 51.

In a case where the recording medium sheet having two thermochromic layers 61 is used, the first protecting layer 62 on top of one thermochromic layer 61 is made of a transparent material and the second protecting layer 62 on top of the other thermochromic layer 61 is made of an opaque material. In a case where the recording medium sheet having one thermochromic layer 61 is used, the protecting layer 62 on top of the thermochromic layer 61 is made of an opaque material and the supporting layer 60 is made of a transparent material. When the recording medium sheet is displayed on the displaying unit 4, the front surface of the sheet that is transparent is directed to the front side of the displaying unit 4. As described previously, the movable writing member 45 writes information to the reverse surface of the sheet which is opaque when the recording medium sheet is displayed on the displaying unit 4.

When information is written to one thermochromic layer 61 of the recording medium sheet, the heat influence on the other thermochromic layer 61 of the same sheet can be attenuated due to the supporting layer 60 between the two thermochromic layers 61. The heat due to the writing is diffused or absorbed in the supporting layer 60, and the temperature of the thermochromic layer on the opposite side of the sheet is not increased to the coloring temperature.

The protecting layer 62 of the recording medium sheet is processed to prevent electric conduction on the sheet surface. Due to the electric conduction preventing processing of the supporting layer 62, it is possible to prevent two or more recording medium sheets from being attracted to each other due to static electricity. It is possible to prevent the dust or foreign matter from attaching to each recording medium sheet. A front/reverse surface detection marking and a precaution notice (for warning against damaging the sheet, perforating thereof and using permanent ink) are printed to the recording medium sheet of the present invention.

Further, the present invention is not limited to the above described embodiments, and variations and modifications may be made without departing from the scope of the present invention.

What is claimed is:

1. An apparatus for displaying a recording medium sheet and for printing an image on the sheet, said apparatus comprising:

a plurality of sheets each of which is made of an erasable recording medium;

recording means for recording information on one of said plurality of sheets;

displaying means for displaying said sheet on which information is recorded by said recording means, said sheet being set at a display position when it is displayed;

sheet supplying means for supplying one of said sheets to said recording means, and for receiving said displayed sheet from said displaying means; and first sheet passage means in which one of said sheets is transported from said displaying means to said sheet supplying means via said recording means and transported from said sheet supplying means to said displaying means via said recording means.

2. An apparatus according to claim 1, further comprising a plurality of transporting means provided at portions of said first sheet passage means for transporting each sheet from said displaying means to said sheet supplying means and for transporting each sheet from said sheet supplying means to said displaying means.

3. An apparatus according to claim 1, wherein said first sheet passage means comprises a first passage connecting said sheet supplying means to said recording means, a second passage connecting said recording means to said displaying means, a third passage connecting said recording means to said sheet supplying means, and a selecting lever provided at a portion where said first passage and said third passage join.

4. An apparatus according to claim 1, further comprising a plurality of transporting means for transporting each sheet from said displaying means to said sheet supplying means through said first sheet passage means, and for transporting each sheet from said sheet supplying means to said displaying means through said first sheet passage means.

5. An apparatus according to claim 1, wherein said displaying means is formed integrally with a covering plate of said sheet supplying means, and said displaying means formed with said covering plate is rotatably supported on said recording means.

6. An apparatus according to claim 1, further comprising a plurality of transporting means for transporting each sheet from said displaying means to said sheet supplying means through said first sheet passage means after said sheet is set at said display position.

7. An apparatus according to claim 1, further comprising:

a transparent window part provided on a front surface of said displaying means, each recording medium sheet being placed on a reverse surface of said transparent window part when the sheet is displayed;

a movable writing member for writing information to each recording medium sheet from a reverse surface of the sheet; and a plurality of illuminating lamps provided between a rear surface of the displaying means and a covering plate of the sheet supplying means for illuminating each recording medium sheet from the reverse surface of the sheet.

8. An apparatus according to claim 7, further comprising a frame for accommodating the window part, the movable writing member, the illuminating lamps, and the covering plate, said frame being rotatably supported on the recording means by a supporting shaft, said supporting shaft being connected to a bottom portion of the frame.

9. An apparatus according to claim 7, further comprising detection means for detecting a position of each recording medium sheet by sensing a marking printed at said position of the sheet.

10. An apparatus according to claim 1, further comprising erasing means provided in said first sheet passage means for erasing information from one of the sheets from said displaying means.

11. An apparatus according to claim 10, wherein said erasing means is heated to a temperature at which the sheet is caused to a colored condition, when the sheet passes through the erasing means.

12. An apparatus according to claim 1, wherein said sheet supplying means includes a sensor for detecting whether a sheet rests on a front surface or on a reverse surface of said sheet, said sensor outputting a detection signal indicating that said sheet rests thereon before said sheet is supplied to said recording means, and said sheet supplying means supplying said sheet to said recording means from a first feeding opening or a second feeding opening in accordance with said detection signal from said sensor.

13. An apparatus according to claim 1, wherein each of said recording medium sheets comprises a thermochromic layer and a flexible supporting layer on which said thermochromic layer is supported.

14. An apparatus according to claim 13, wherein said thermochromic layer comprises a material holding information recorded thereon when above a normal temperature but causing said information recorded onto said thermochromic layer to disappear when the material is cooled to a normal temperature.

15. An apparatus according to claim 13, wherein said thermochromic layer of each recording medium sheet comprises an electron supplying component, an electron donor component, a binding agent component, and an additive.

16. An apparatus according to claim 13, wherein a second thermochromic layer made of a non-erasable recording medium is formed at a prescribed portion of the sheet in place of said thermochromic layer.

17. An apparatus according to claim 1, wherein each recording medium sheet comprises a flexible supporting layer, a first thermochromic layer supported on a surface of said supporting layer, a second thermochromic layer supported on the other surface of said supporting layer, a transparent protecting layer on said first thermochromic layer, and an opaque protecting layer on said second thermochromic layer.

18. An apparatus according to claim 1, wherein each recording medium sheet comprises a flexible supporting layer, a first thermochromic layer supported on a surface of said supporting layer, and a second thermochromic layer supported on the other surface of said supporting layer, and wherein said supporting layer is made of an opaque material.

19. An apparatus according to claim 1, wherein each recording medium sheet is removable from said displaying means when the recording medium sheet is set at the display position on said displaying means after the recording of the information by said recording means is finished.

* * * * *